US009558708B2

(12) United States Patent
Ura et al.

(10) Patent No.: US 9,558,708 B2
(45) Date of Patent: Jan. 31, 2017

(54) DISPLAY DRIVE CIRCUIT AND DISPLAY DEVICE

(71) Applicant: Synaptics Japan GK, Tokyo (JP)

(72) Inventors: Yoshinori Ura, Tokyo (JP); Kiichi Makuta, Tokyo (JP); Toshikazu Arai, Tokyo (JP); Jun Uchida, Tokyo (JP); Keita Tsubakino, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 0 days.

(21) Appl. No.: 14/533,460

(22) Filed: Nov. 5, 2014

(65) Prior Publication Data

US 2015/0124006 A1 May 7, 2015

(30) Foreign Application Priority Data

Nov. 6, 2013 (JP) ..... 2013-230046

(51) Int. Cl.
*G09G 5/10* (2006.01)
*G09G 3/36* (2006.01)

(52) U.S. Cl.
CPC ..... *G09G 3/3696* (2013.01); *G09G 3/3688* (2013.01); *G09G 2310/0291* (2013.01); *G09G 2320/0223* (2013.01); *G09G 2320/0276* (2013.01)

(58) Field of Classification Search
CPC .. G09G 3/2007; G09G 3/3291; G09G 3/3685; G09G 2310/0291; G09G 2320/0223; G09G 2320/0276
USPC ..... 345/77, 89, 92, 204–214, 589, 690–692; 173/1; 324/414; 327/330, 560
See application file for complete search history.

(56) References Cited

U.S. PATENT DOCUMENTS 3,031,774 A * 5/1962 Hackett ..... G01S 7/4021 434/4
4,081,037 A * 3/1978 Jonsson ..... B25B 23/1456 173/1
5,583,532 A * 12/1996 Watanabe ..... G09G 3/3696 345/89
6,016,132 A * 1/2000 Takahashi ..... G09G 3/32 345/690
6,498,596 B1 * 12/2002 Nakamura ..... G09G 3/2011 341/144

(Continued)

FOREIGN PATENT DOCUMENTS

JP 2008292926 A 12/2008
JP 2012255860 A 12/2012

*Primary Examiner* — Prabodh M Dharia
(74) *Attorney, Agent, or Firm* — Patterson + Sheridan, LLP

(57) ABSTRACT

A display drive circuit includes: source amplifiers capable of driving source lines of a display panel connected thereto; preamplifiers capable of outputting first gradation voltages; source circuits each including a division of the source amplifiers, provided that the source amplifiers are divided equally; and resistance arrays. Each source circuit is provided with one of the resistance arrays. Each resistance array divides input first gradation voltages to generate second gradation voltages and provides them to the corresponding source circuit. The worsening of the capability of converging of gradation lines for supplying second gradation voltages to the source circuits can be suppressed without providing gradation-voltage-generation circuits even with a display driver IC having an increased long side length, or more than one display driver IC provided.

13 Claims, 11 Drawing Sheets

(56) References Cited

U.S. PATENT DOCUMENTS 7,760,178 B2 * 7/2010 Takada ..... G09G 3/3688 345/690
8,319,767 B2 * 11/2012 Hiratsuka ..... G09G 3/3688 345/208
2002/0044142 A1 * 4/2002 Fukuda ..... G09G 3/3696 345/204
2002/0093495 A1 * 7/2002 Akimoto ..... G09G 3/2011 345/204
2006/0017670 A1 * 1/2006 Yaguma ..... G09G 3/3275 345/77
2006/0087227 A1 * 4/2006 Yamanaka ..... H01L 27/3211 313/504
2006/0087483 A1 * 4/2006 Takada ..... G09G 3/3688 345/89
2006/0109225 A1 * 5/2006 Haga ..... G09G 3/3648 345/92
2006/0202744 A1 * 9/2006 Utsuno ..... G09G 3/3688 327/538
2007/0001939 A1 * 1/2007 Hashimoto ..... G09G 3/3233 345/76
2007/0040846 A1 * 2/2007 Kim ..... G09G 5/02 345/589
2007/0057894 A1 * 3/2007 Natori ..... G09G 3/3611 345/98
2007/0200746 A1 * 8/2007 Sutardja ..... H03M 1/363 341/155
2007/0296490 A1 * 12/2007 Elwan ..... H03G 1/0088 330/86
2008/0074404 A1 * 3/2008 Sashida ..... G09G 3/3648 345/204
2008/0111773 A1 * 5/2008 Tsuge ..... G09G 3/3241 345/76
2008/0129722 A1 * 6/2008 Qi ..... G09G 3/3688 345/212
2009/0066732 A1 * 3/2009 Miyamoto ..... G09G 3/3688 345/690
2009/0289959 A1 * 11/2009 Tanaka ..... G09G 3/3648 345/690
2011/0007057 A1 * 1/2011 Fukuo ..... G09G 3/3614 345/211
2013/0009935 A1 * 1/2013 Yanagi ..... G09G 3/3688 345/211
2013/0147382 A1 * 6/2013 Lee ..... G09G 3/3406 315/210
2013/0321382 A1 * 12/2013 Nagao ..... G09G 3/3696 345/212
2014/0085349 A1 * 3/2014 Shiibayashi ..... G09G 5/10 345/690
2015/0109348 A1 * 4/2015 Hikichi ..... G09G 5/10 345/690
2015/0219945 A1 * 8/2015 Kimura ..... G09G 3/20 349/152

* cited by examiner

DISPLAY DRIVE CIRCUIT AND DISPLAY DEVICE

CROSS-REFERENCE TO RELATED APPLICATIONS

The Present application claims priority from Japanese application JP 2013-230046 filed on Nov. 6, 2013, the content of which is hereby incorporated by reference into this application.

BACKGROUND

Embodiments generally relate to a display drive circuit and a display device having the display drive circuit, and particularly to a display drive circuit which can be suitably utilized as a display drive circuit operable to drive source lines of a display panel.

The rise in the degree of high definition display panels including LCD panels (LCD: Liquid Crystal Display) or organic EL display panels (OELD: Organic Electro Luminescence Display) leads to the increase in the number of outputs of source drivers for driving source lines (also, termed "data lines") that a display panel has, and makes longer the length of a long side of a semiconductor chip (also, termed "display driver IC (Integrated Circuit)") having a display drive circuit. For instance, source drivers are arranged along a chip's long side, and they produce analog signals of voltage levels corresponding to display data from gradation lines wired commonly and serving to supply gradation voltages, and drive source lines. With the chip having a larger long side, the gradation lines extending to inputs of the source drivers are longer in their lengths, which consequently increases the parasitic resistance and the parasitic capacitance, worsens the capability of converging of the gradation lines and therefore, causes a delay in the converging time of the source lines.

The Japanese Unexamined Patent Application Publication No. JP-A-2012-255860 discloses a display driver IC which is operable to work at a higher speed, and arranged to have a reduced parasitic resistance and a reduced parasitic capacitance. The display driver IC has a gamma-gradation-voltage-generation circuit operable to generate gradation voltages arranged in a center portion thereof with a group of gamma-gradation-voltage-signal lines (corresponding to the "gradation lines") wired to extend to the right and left along its long side direction.

JP-A-2008-292926 discloses a circuit which avoids the occurrence of variation in gradation voltages among display driver ICs in the case of driving a display part (display panel) by use of the display driver ICs. The display driver ICs each have a gradation-voltage-generation circuit; gradation reference voltages are uniformized by mutually connecting adjacent display driver ICs' gradation lines corresponding to each other.

SUMMARY

One example disclosed herein includes a display drive circuit having a plurality of source amplifiers capable of driving source lines of a display panel to connect with respectively. The display drive circuit comprises a plurality of preamplifiers operable to output first gradation voltages. The display drive circuit also comprises a plurality of source circuits, including divisions of the plurality of source amplifiers respectively. The display drive circuit also comprises a plurality of resistance arrays provided corresponding to the plurality of source circuits respectively, wherein the plurality of resistance arrays are operable to divide the first gradation voltages to generate second gradation voltages, and supply the second gradation voltages to corresponding source circuits.

Another example disclosed herein includes a display device. The display device includes a display panel having a plurality of source lines, and a display drive circuit connected with the display panel, and including a plurality of source amplifiers configured to drive the plurality of source lines. The display drive circuit includes a plurality of preamplifiers operable to output first gradation voltages. The display drive circuit also includes a plurality of source circuits including divisions of the plurality of source amplifiers respectively. The display drive circuit also includes a plurality of resistance arrays which are provided corresponding to the plurality of source circuits respectively, wherein the plurality of resistance arrays are operable to divide the first gradation voltages input thereto to generate second gradation voltages, and supply the second gradation voltages to corresponding source circuits.

Another example disclosed herein includes a display device comprising a display panel having a plurality of source lines and a display drive circuit connected with the display panel, and including a plurality of source amplifiers configured to drive the plurality of source lines. The display drive circuit includes a plurality of preamplifiers operable to output first gradation voltages. The display drive circuit also includes a plurality of source circuits including divisions of the plurality of source amplifiers respectively. The display drive circuit also includes a plurality of resistance arrays which are provided corresponding to the plurality of source circuits respectively, wherein the plurality of resistance arrays are operable to divide the first gradation voltages input thereto to generate second gradation voltages, and supply the second gradation voltages to corresponding source circuits.

DETAILED DESCRIPTION

Introduction

Figure 1:
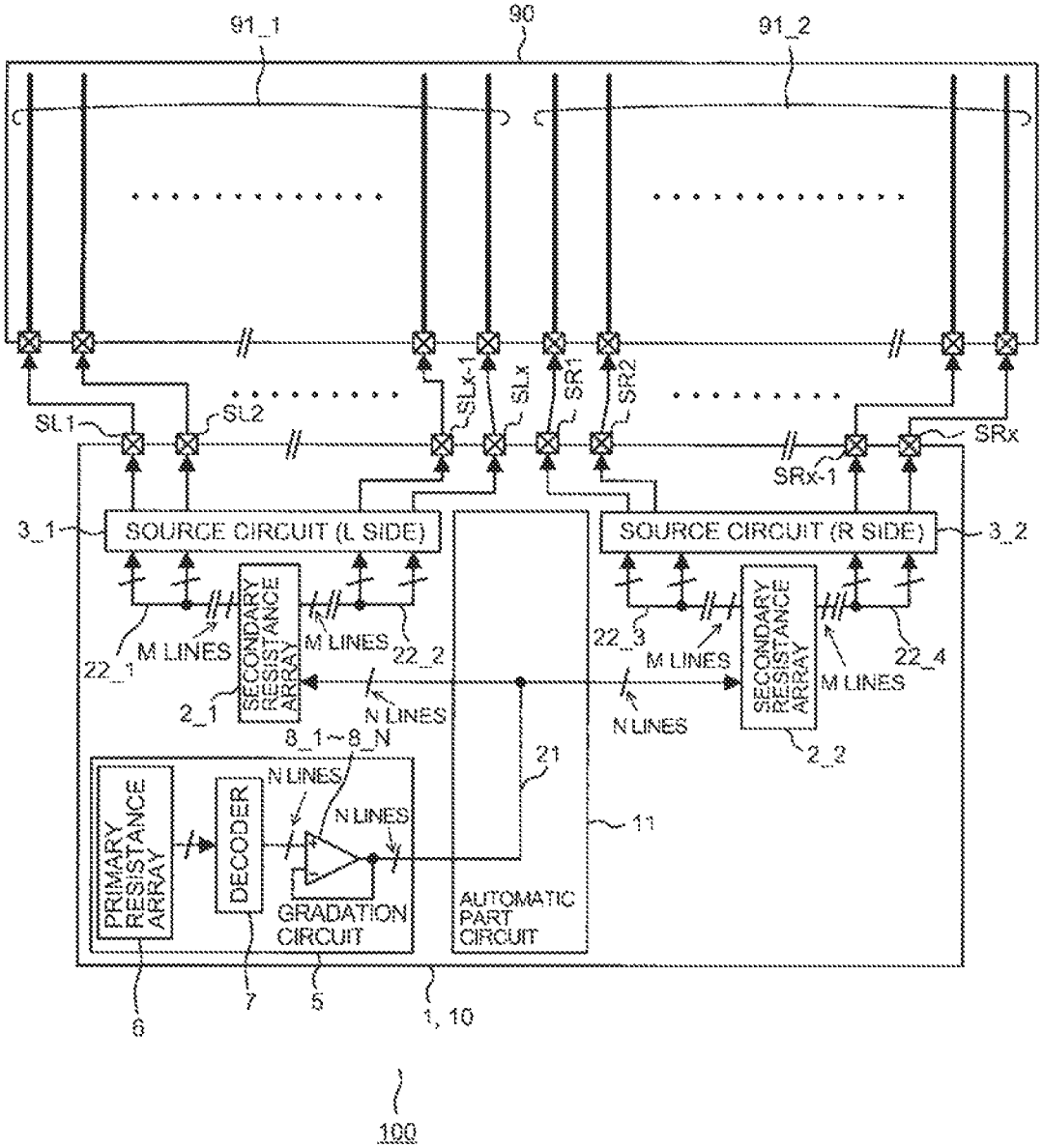
FIG. 1 is a block diagram showing an example of the configuration of a display drive circuit and a display device according to the first embodiment.

According to the technique described in JP-A-2012-255860, the line lengths of gradation lines can be reduced to about a half of the long side length of display driver ICs, but they cannot be shortened more than that. If a pair of display driver ICs as described in JP-A-2008-292926 are integrated into one display driver IC, the line lengths from a circuit operable to generate gradation voltages to far ends of the gradation lines can be reduced to about a quarter of the long side length of the integrated display driver IC. But, in such a case, one chip would include a pair of gradation-voltage-generation circuits, and thus the chip area would be increased. In addition, making a short circuit between far ends of gradation lines which are supplied from different gradation-voltage-generation circuits, a step of display brightness owing to the difference between generated gradation voltages can be made harder to stand out, but gradation voltages to be generated per se cannot be uniformized.

One advantage of the disclosed embodiments is to suppress the worsening of the capability of converging of gradation lines without providing gradation-voltage-generation circuits even with a display driver IC having an increased long side length, or a plurality of display driver ICs provided.

Disclosed herein is a display drive circuit having a plurality of source amplifiers operable to drive source lines of a display panel connected therewith. The display drive circuit includes: a plurality of preamplifiers operable to output first gradation voltages; a plurality of source circuits each including a source amplifier; and a plurality of resistance arrays. The plurality of resistance arrays are provided, one for each source circuit, and divide, in voltage, first gradation voltages input to themselves to produce second gradation voltages, and supply them to the corresponding source circuits.

It is possible to suppress the worsening of the capability of converging of gradation lines for supplying second gradation voltages to the source circuits without providing gradation-voltage-generation circuits even with a display driver IC having an increased long side length, or a plurality of display driver ICs provided.

1. Summary of the Embodiments

First, summary of representative embodiments will be described. Reference numerals in drawings in parentheses referred to in description of the summary of the representative embodiments just denote components included in the concept of the components to which the reference numerals are designated.

[1] Arrangement of Secondary Strings (Resistance Arrays) in a Distributed Form

The display drive circuit according to an embodiment is a display drive circuit (1, 10) including a plurality of source amplifiers (4) capable of driving source lines (91_1, 91_2) of a display panel (90) to connect with respectively. The display drive circuit is arranged as described below.

The display drive circuit includes: a plurality of preamplifiers (8_1 to 8_N) operable to output first gradation voltages; a plurality of source circuits (3_1, 3_2, 3_3, 3_4), including divisions of the plurality of source amplifiers respectively; and a plurality of resistance arrays (2_1, 2_2, 2_3, 2_4) provided corresponding to the plurality of source circuits respectively, dividing the first gradation voltages to generate second gradation voltages on receipt of inputs thereof, and supplying the second gradation voltages to the corresponding source circuits.

According to the embodiment like this, the worsening of the capability of converging of the gradation lines (22) for supplying second gradation voltages to the source circuits (3_1, 3_2, 3_3, 3_4) can be suppressed without providing gradation-voltage-generation circuits even with the display driver IC(10) having a long side increased in length or display driver ICs (10_1, 10_2) provided therein.

[2] Secondary Strings Disposed in Center Portions of Source Circuits

In the display drive circuit as described in [1], the plurality of source circuits each include a plurality of source amplifiers (4), provided that numbers of the source amplifiers included by the source circuits are roughly equal to each other; and the plurality of source amplifiers are arrayed in a first direction (e.g. a long side direction of the display driver IC 10). Each resistance array is disposed in a roughly center portion of a width of the corresponding source circuit in the first direction to array the source amplifiers included in the source circuit. Gradation lines (22_1, 22_2, 22_3, 22_4) are wired from each resistance array (2_1, 2_2) toward opposing ends of the corresponding source circuit (3_1, 3_2) in the first direction.

According to the embodiment like this, the numbers of source amplifiers connected with the secondary strings (resistance array), and the line lengths to the respective far ends are made roughly uniform for all the source circuits (3_1, 3_2), whereby the effect of suppressing the worsening of the capability of converging of the gradation lines (22) is increased.

[3] One Chip×Two Divisions

The display drive circuit as described in [1] further includes a gradation circuit (5), wherein the plurality of source amplifiers are arrayed in a first direction (e.g. a long side direction of the display driver IC 10). The gradation circuit (5) includes a circuit (6, 7) operable to generate the first gradation voltages and the plurality of preamplifiers (8_1 to 8_N). Two source circuits (3_1, 3_2) each include a number of the source amplifiers (4), provided that the numbers of the source amplifiers included by the two source circuits are the same. Two resistance arrays (2_1, 2_2) supply the second gradation voltages to the corresponding source circuits. The gradation circuit, the two source circuits, the two resistance arrays are formed on a single semiconductor substrate. The two resistance arrays are each disposed in a roughly center portion of a width of the corresponding source circuit in the first direction. Gradation lines (22_1, 22_2, 22_3, 22_4) are wired from each resistance array (2_1, 2_2) toward opposing ends of the corresponding source circuit in the first direction.

According to the embodiment like this, the worsening of the capability of converging of the gradation lines (22) can be suppressed in the display driver IC(10) arranged in a single chip even in the case that the long side of the display driver IC(10) is made longer in length.

[4] Short-Circuit Left and Right Gradation Lines

In the display drive circuit as described in [3], of the gradation lines wired toward one source circuit (3_1), the gradation line (22_2) wired toward the other source circuit (3_2) is electrically connected with the gradation line (22_3) wired from the other source circuit (3_2) toward the one source circuit.

According to the embodiment like this, even in the case of second gradation voltages generated by two secondary strings (2_1, 2_2), second gradation voltages corresponding to each other have a difference therebetween, a steep step does not arise in terms of display because the difference is smoothed out at a connection point of two source circuits (3_1, 3_2), and thus the second gradation voltages in question are smoothly connected there.

[5] One Chip×Multiple Divisions

The display drive circuit as described in [1] further includes a gradation circuit (5), wherein the plurality of source amplifiers are arrayed in a first direction (e.g. a long side direction of the display driver IC 10). The gradation circuit (5) includes a circuit (6, 7) operable to generate the first gradation voltages and the plurality of preamplifiers (8_1 to 8_N). Source circuits (3_1 to 3_4) each include a number of the source amplifiers (4), provided that the numbers of the source amplifiers included by the two source circuits are roughly the same. Resistance arrays (2_1 to 2_4) supply the second gradation voltages to the corresponding source circuits. The gradation circuit, the source circuits, and the resistance arrays are formed on a single semiconductor substrate. The resistance arrays are each disposed in a roughly center portion of a width of the corresponding source circuit in the first direction. Gradation lines are wired from each resistance array toward opposing ends of the corresponding source circuit in the first direction.

According to the embodiment like this, the worsening of the capability of converging of the gradation lines (22) can be suppressed in the display driver IC(10) arranged in a single chip even in case that the long side of the display driver IC(10) is made longer in length. Further, the worsening of the capability of converging of gradation lines can be suppressed to a smaller degree in comparison to that achieved by the embodiment as described in [3].

[6] Short Circuit of Gradation Lines Between Adjacent Source Circuits

In the display drive circuit as described in [5], between source circuits adjacent to each other, of the gradation lines, of the gradation lines wired to one source circuit, the gradation line wired toward the other source circuit is electrically connected with the gradation line wired from the other source circuit toward the one source circuit.

According to the embodiment like this, even in case of second gradation voltages generated by each of the secondary strings, second gradation voltages corresponding to each other have a difference therebetween, a steep step does not arise in terms of display because the difference is smoothed out at a connection point of two source circuits adjacent to each other, and thus the second gradation voltages in question are smoothly connected there.

[7] Master Chip of Multi-Chip Structure

The display drive circuit as described in [3] which is arranged to be able to output the first gradation voltages outside a chip (23).

According to the embodiment like this, as to the display driver IC is constituted by multiple chips, it is possible to provide a master display driver IC(10_1) capable of supplying a first gradation voltage making a standard for other slave chips.

[8] Slave Chip in Multiple-Chip Structure

In the display drive circuit as described in [3], the gradation circuit is arranged so that the first gradation voltages can be input from outside a chip instead of the circuit (6, 7) operable to generate first gradation voltages (24), and the plurality of preamplifiers (9_1 to 9_N) generate internal first gradation voltages based on the first gradation voltages input from the outside, and supply the voltages to the resistance arrays (2_3, 2_4).

According to the embodiment like this, as to the display driver IC(10_1, 10_2) constituted by multiple chips, it is possible to provide a slave display driver IC(10_2) which generates secondary gradation voltages respectively based on first gradation voltages supplied by the master chip (10_1) as described in [7].

[9] Automatic Part Circuit (Display-Data-Supply Circuit in a Center Portion)

The display drive circuit as described in [3], [4], [7], or [8] further includes a display-data-supply circuit (11). The display-data-supply circuit is capable of supplying input display data to the corresponding source circuits (3_1, 3_2). The source circuit includes a gradation-voltage-select circuit which generates, from the second gradation voltages, analog voltages corresponding to the display data based on supplied display data, and supplies the analog voltages to the plurality of source amplifiers (4). The display-data-supply circuit is disposed between the two source circuits (3_1, 3_2).

According to the embodiment like this, the display-data-supply circuit (11) operable to supply display data to the source circuits (3_1, 3_2) can be disposed (laid out) efficiently. The display-data-supply circuit (11) is a digital circuit, which is laid out in a collective region together with other digital circuits. In such layout, the display-data-supply circuit is laid out in a long and narrow region, e.g. a rectangular region with a large aspect ratio in a long side direction of the display driver IC, the short side of the display driver IC(10) cannot be shortened. However, laying out the display-data-supply circuit (11) as described in [9], the short side of the display driver IC(10) can be made shorter. The long side of the display driver IC (10) is disposed along the edge of the display panel (90), whereas its short side would affect the surroundings of the display panel (90) and a so-called frame size. Making shorter the short side of the display driver IC (10), it is possible to contribute to the narrower frame arrangement in the case of mounting the display driver IC (10) along a side of the display panel (90) in the display device (100).

[10] Effective Use of a Repeater Buffer Layout Region

In the display drive circuit as described in any one of [2] to [9], the source circuits in the plurality of source circuits each includes a group of digital signal lines extending in the first direction, and at least one group of buffers for restoring signal levels of the group of digital signal lines respectively, the group of buffers being disposed in a region with opposing ends in contact with the source amplifiers. The resistance array is laid out in one region of regions to lay out the group of buffers in together with the group of buffers.

According to the embodiment like this, the layout efficiency of the secondary strings (resistance arrays) can be increased, and the chip area can be reduced. The source circuits are laid out to be longer in a long side direction of the display driver IC. In some cases, it is necessary to provide a buffer (i.e. repeater buffer) on its way to each of the left and right ends to restore their signal levels. This is because the line length is made longer for digital signals which are supplied as if they are caused to traverse. In such a case, the buffer layout regions end up including an unused region with the layout regions located at the same height as the height of the source amplifiers because a buffer is a simple circuit. By laying out the secondary strings (resistance arrays) and a group of buffers in one region, unused regions are reduced, and thus the layout efficiency can be increased.

[11] Arrangement on Supply Lines of First Gradation Voltages for Lower Resistance In the display drive circuit as described in any one of [1] to [10], the line resistance per unit length of a line for supplying the first gradation voltages to the plurality of resistance arrays (2_1 to 2_4) from the plurality of preamplifiers (8_1 to 8_N) is lower than a line resistance per unit length of lines (22) for supplying the second gradation voltages.

According to the embodiment like this, the worsening of the capability of converging of gradation lines can be suppressed more efficiently. The number of lines for supplying first gradation voltages is as small as a fraction of the number of lines for supplying second gradation voltages. On this account, lines for supplying the first gradation voltages are made to have a lower resistance selectively, thereby making larger the effect of suppressing the capability of converging of gradation lines to the cost for the lines to have a lower resistance (e.g. to the increase in chip area).

[12] Supply Lines of First Gradation Voltages Having a Larger Width

In the display drive circuit as described in [11], a line width of the line (21) for supplying the first gradation voltages is wider than the line width of a line (22) for supplying the second gradation voltages.

According to the embodiment like this, the lower resistance can be achieved readily even in the case of arranging the line (21) for supplying first gradation voltages, and the line (22) for supplying second gradation voltages in the same wiring layer, or arranging them in different wiring layers having the same line material and the same thickness. On the other hand, a line having lower resistance may be achieved by arranging the line (21) for supplying first gradation voltages in a wiring layer different from that for the line (22) for supplying second gradation voltages, and using a line material having a lower resistance, or increasing the thickness of the wiring layer.

[13] Display Device, and Arrangement of Secondary Strings (Resistance Arrays) in a Distributed Form The display device according to an embodiment is a display device (100) including:

a display panel (90) having a plurality of source lines (91_1, 91_2); and a display drive circuit (1, 10) connected with the display panel and including a plurality of source amplifiers (4) capable of driving the plurality of source lines respectively. The display device is arranged as described below.

The display drive circuit (1, 10) includes: a plurality of preamplifiers (8_1 to 8_N) operable to output first gradation voltages; a plurality of source circuits (3_1, 3_2, 3_3, 3_4) including divisions of the plurality of source amplifiers respectively; and a plurality of resistance arrays (2_1, 2_2, 2_3, 2_4) which are provided corresponding to the plurality of source circuits, divide the first gradation voltages input thereto to generate second gradation voltages, and supply the second gradation voltages to the corresponding source circuits.

According to the embodiment like this, it becomes possible to provide a display device which enables the suppression of the worsening of the capability of converging of the gradation lines (22) for supplying second gradation voltages to the source circuits (3_1, 3_2, 3_3, 3_4) without providing gradation-voltage-generation circuits even with the display driver IC(10) on which a display drive circuit is to be mounted and which has a long side increased in length or display driver ICs (10_1, 10_2) provided therein.

[14] Display Device and One Chip×Two Divisions

In the display device as described in [13], the plurality of source amplifiers is arrayed in a first direction (e.g. a long side direction of the display driver IC 10). The display drive circuit has: a gradation circuit (5) including a circuit (6, 7) operable to generate the first gradation voltages and the plurality of preamplifiers (8_1 to 8_N); two source circuits (3_1, 3_2) including the source amplifiers, provided that numbers of the source amplifiers included by the two source circuits are roughly equal to each other; and two resistance arrays (2_1, 2_2) operable to supply the second gradation voltages to the corresponding source circuits, the gradation circuit, the two source circuits and the two resistance arrays are formed on a single semiconductor substrate. The two resistance arrays are each disposed in a roughly center portion of a width of the corresponding source circuit in the first direction, and gradation lines are wired from each resistance array toward opposing ends of the corresponding source circuit in the first direction.

According to the embodiment like this, the worsening of the capability of converging of the gradation lines (22) can be suppressed in the display device (100) having the display driver IC(10) formed in a single chip, even in case that the long side of the display driver IC(10) is made longer in length.

[15] Display Device; Display Driver ICs

In the display device as described in any one of [13], the display drive circuit includes a master display driver IC (10_1) and at least one slave display driver IC (10_2). The master display driver IC and the at least one slave display driver IC each include a plurality of source amplifiers (4), provided that the plurality of source amplifiers (4) are capable of driving, of the plurality of source lines, groups of source lines different from each other respectively.

The master display driver IC (10_1) includes: the plurality of preamplifiers (8_1 to 8_N); a plurality of master source circuits (3_1, 3_2) included by the plurality of source circuits; and a plurality of master resistance arrays (2_1, 2_2) which are provided corresponding to the plurality of master source circuits, divide the first gradation voltages output from the plurality of preamplifiers to generate second gradation voltages, and supply the second gradation voltages to the corresponding master source circuit, the master display driver IC is provided on a single semiconductor substrate, and the master display driver IC is capable of outputting the first gradation voltages to outside a chip (23).

The at least one slave display driver IC (10_2) is capable of accepting input (24) of the first gradation voltages output by the master display driver IC; the at least one slave display driver IC includes: a plurality of slave preamplifiers (9_1 to 9_N) output internal first gradation voltages based on the input first gradation voltages; a plurality of slave source circuits (3_3, 3_4) included by the plurality of source circuits, and different from the plurality of master source circuits; and a plurality of slave resistance arrays (2_3, 2_4) which are provided corresponding to the plurality of slave source circuits, divide the first gradation voltages output by the plurality of slave preamplifiers to generate second gradation voltages, and supply the second gradation voltages to the corresponding slave source circuits, and the at least one slave display driver IC being formed on a single semiconductor substrate different from a single semiconductor substrate on which the master display driver IC is formed.

According to the embodiment like this, in the display device (100) having a display driver IC (10_1, 10_2) constituted by multiple chips, the worsening of the capability of converging of the gradation line (22) can be suppressed without providing gradation-voltage-generation circuits on each display driver IC (10_1, 10_2). Only the master display driver IC (10_1) has a gradation-voltage-generation circuit (5), and it supplies first gradation voltages produced by a master to the other slave display drivers ICs. Thus, the variations can be prevented from being caused in first gradation voltages. The second gradation voltages are produced from first gradation voltages, which are the same as supplied ones and therefore, even if variations are caused between display driver ICs, such variations should be sufficiently small.

2. Further Detailed Description of the Embodiments

The embodiments will be described further in detail.

First Embodiment

Arrangement of Secondary Strings in a Distributed Form (One Chip×Two Divisions)

Figure 2:
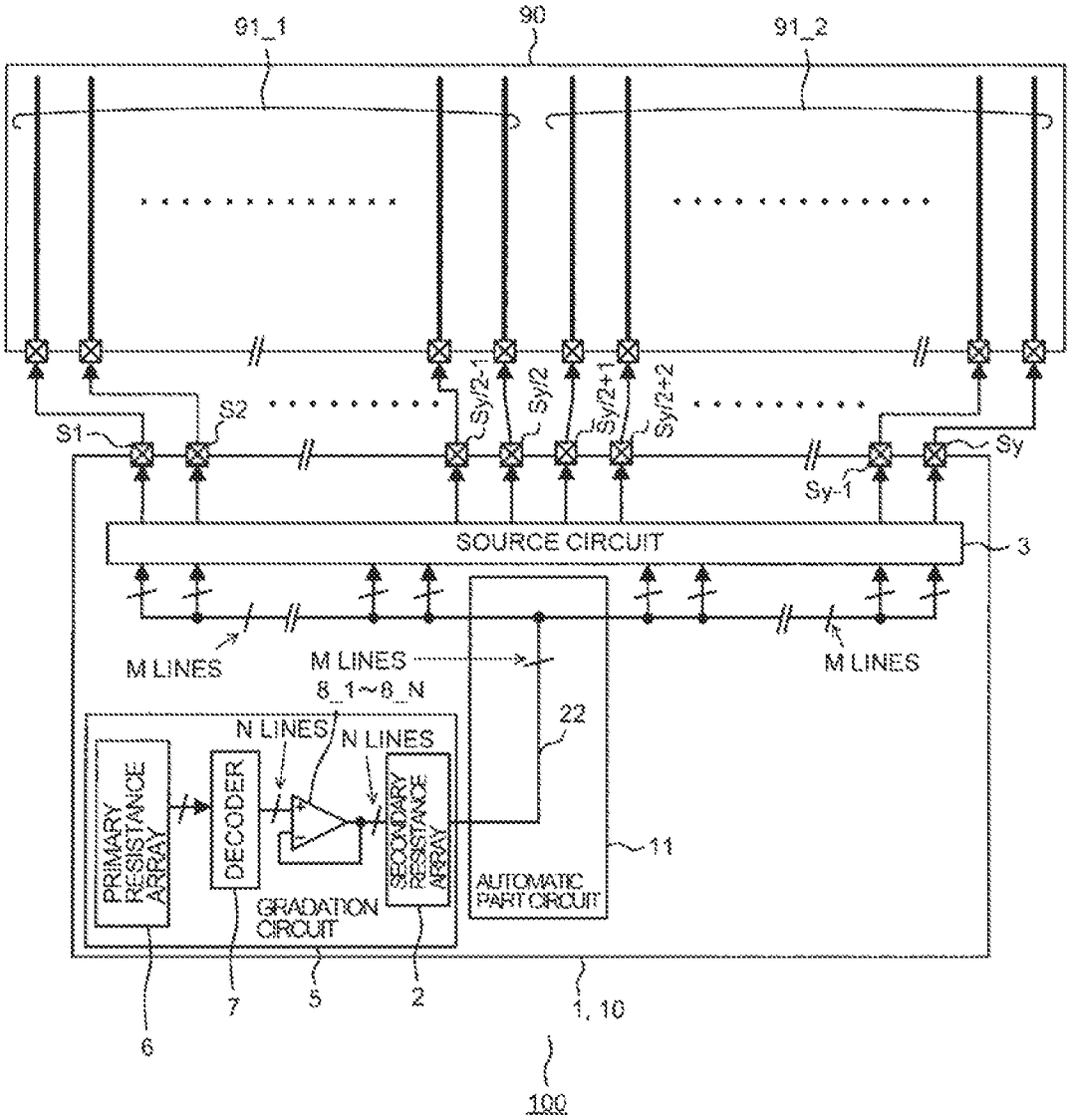
FIG. 2 is a block diagram showing an example of the configuration of a display drive circuit and a display device as a comparative example.

FIG. 1 is a block diagram showing an example of the configuration of a display drive circuit 1 and a display device 100 according to the first embodiment. Further, FIG. 2 is a block diagram showing an example of the configuration of a conventional display drive circuit 1 and a conventional display device 100 as a comparative example.

First, the structure of the conventional display device 100 shown in FIG. 2 as a comparative example will be described. The display device 100 includes: a display panel 90 having source lines 91_1 to 91_2; and a display drive circuit 1 including a plurality of source amplifiers 4 (not shown) which are connected with the display panel 90 and capable of driving source lines 91_1 to 91_2 respectively. The display panel 90 is an active matrix type one, e.g. a liquid crystal display panel or an organic EL display panel. In the display device 100, analog voltages corresponding to display data are applied to display pixels selected by scanning gate lines (also, referred to as "scan lines", which are not shown) from source lines (also, referred to as "data lines") in parallel, thereby deciding the brightness to perform display with on each of the pixels.

The display drive circuit 1 is mounted on the substrate of the display panel 90 as e.g. a display driver IC 10. The display drive circuit 1 may be composed of a single display driver IC 10, or may consist of a plurality of display driver IC chips, e.g. a combination of a master display driver IC 10_1 and a slave display driver IC 10_2 which are to be described later. Although no special restriction is intended, the single display driver IC 10, or the combination of master and slave display driver ICs 10_1 and 10_2 is formed on a single substrate of semiconductor, such as silicon by use of e.g. the known CMOS LSI manufacturing technique (CMOS stands for Complementary Metal-Oxide-Semiconductor field effect transistor; and LSI stands for Large Scale Integrated circuit).

The display drive circuit 1 includes: a source circuit 3; a gradation circuit 5; and an automatic part circuit 11. The source circuit 3 includes a gradation-voltage-select circuit, which is not shown, and source amplifiers 4, and outputs analog voltages to apply to the source lines 91_1 to 91_2 respectively. The source circuit 3 selects, by use of the gradation-voltage-select circuit (not shown), one or two gradations from gradation lines 22 of input M gradations (M is a positive integer) based on display data input separately, generates, based thereon, analog voltages to apply to the source lines, performs conversion of the analog voltages so as to achieve a low impedance by means of source amplifiers 4 (not shown) which are voltage follower power amplifiers, and then outputs the resultant voltages. Incidentally, it is noted that M is a value determined based on display gradations of display data here. For instance, if M=256 with display data of 8 bits and 256 display gradations, the source circuit selects one gradation line corresponding to display data from 256 gradation lines 22, performs the impedance conversion (amplification of electric current) by means of the source amplifiers 4 (not shown), and outputs the resultant voltages. With a large number of gradation lines 22, the line area is large in chip layout. Therefore, M is typically arranged to be smaller than 256, e.g. 80 to 100 approximately. The source amplifiers 4 (not shown) are arranged to be able to select two lines corresponding to display data, to calculate a weighted average by use of lower 2 bits of the display data, and to output 256 gradations of analog voltages. Outputs of the source amplifiers 4 (not shown) are taken out from terminals S1 to Sy (y is a positive integer), and then coupled to the corresponding source lines 91_1 to 91_2 of the display panel 90. Display data are supplied from e.g. an application processor connected with the outside of the display drive circuit 1, temporarily held by a latch circuit in the display drive circuit 1, and supplied to the source circuit 3. The display-data-supply circuit like this includes a digital logic gate.

The gradation lines 22 are supplied with voltages generated by the gradation circuit 5. The gradation circuit is also referred to as "gradation-voltage-generation circuit", and it includes e.g. a primary resistance array ($1^{st}$ string) 6, a decoder 7, preamplifiers 8_1 to 8_N, and a secondary resistance array ($2^{nd}$ string) 2.

Figure 3:
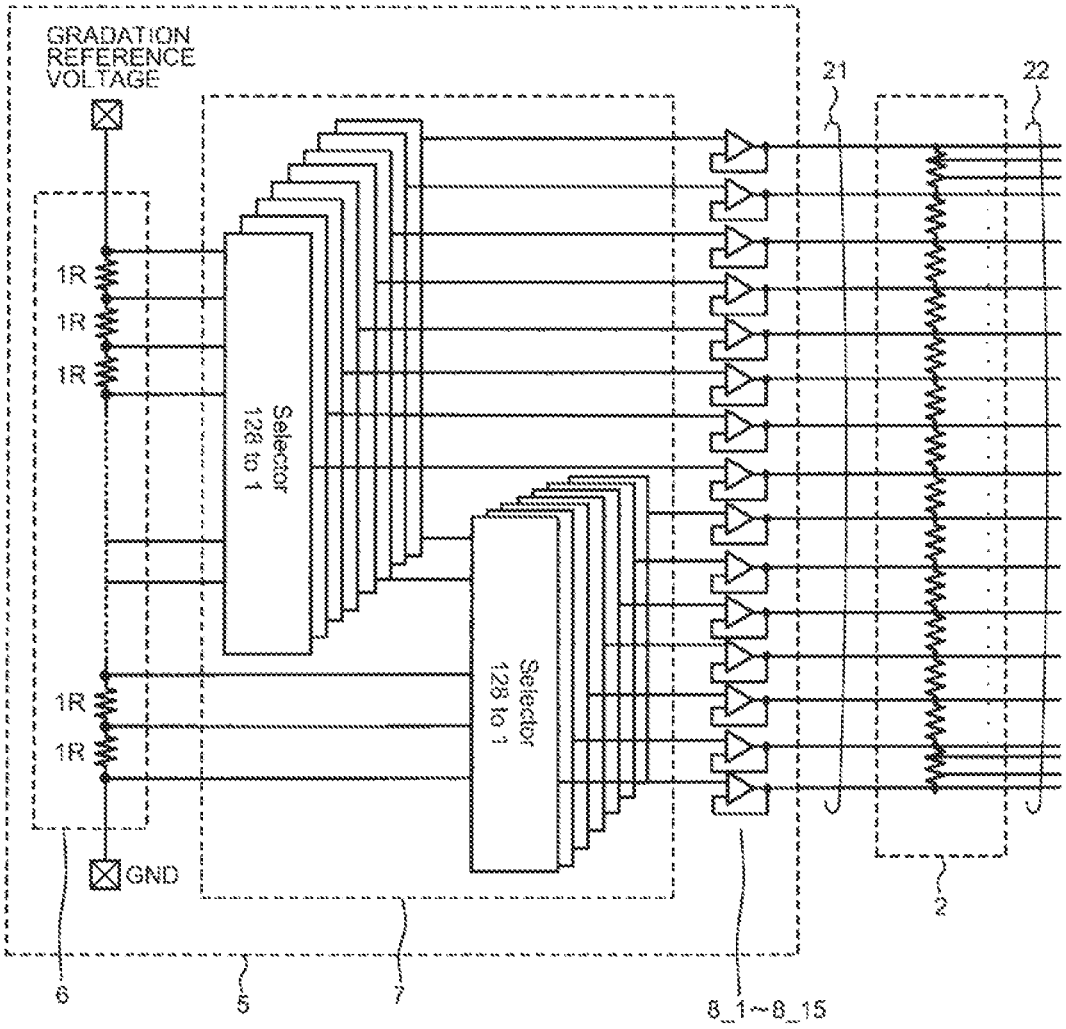
FIG. 3 is a schematic circuit diagram showing an example of the configuration of a gradation circuit.

FIG. 3 is a schematic circuit diagram showing an example of the configuration of the gradation circuit 5. In the example, the gradation circuit 5 includes 15 preamplifiers 8_1 to 8_15, which generates first gradation voltages of 15 gradations and supplies the first gradation voltages to taps of the secondary resistance array ($2^{nd}$ string) 2. The gamma characteristic is determined by the first gradation voltages. Now, it is noted that the 15 preamplifiers 8_1 to 8_15 and the first gradation voltages of 15 gradations are just examples, the number of the preamplifiers and the gradation number of the first gradation voltages may be a value for approximating the gamma characteristic with satisfactory accuracy.

The primary resistance array ($1^{st}$ string) 6 is composed of a resistance array including 127 resistances 1R connected in series, which equally divides a voltage between a gradation reference voltage supplied thereto and the ground level (GND) into voltages of 128 gradations. The decoder 7 includes 15 128-to-1 selectors which select, from the voltages of 128 gradations, voltage levels respectively, and supply them to 15 preamplifiers 8_1 to 8_15. The preamplifiers 8_1 to 8_15 output 15 first gradation voltages, which are supplied to taps of the secondary resistance array ($2^{nd}$ string) 2. The secondary resistance array ($2^{nd}$ string) 2 further divides the 15 first gradation voltages thus supplied to generate second gradation voltages, and supplies them to the source circuit 3.

With reference to FIG. 3, the secondary resistance array ($2^{nd}$ string) 2 is not included in the gradation circuit 5. In contrast, in a conventional display drive circuit, a secondary resistance array ($2^{nd}$ string) 2 is included in a gradation-voltage-generation circuit (gradation circuit 5).

With the display device 100 shown in FIG. 2, the rise in the degree of high definition of the display panel 90 results in the increase in the number of source lines. The number of source lines depends on the number of pixels in a horizontal direction, which has a tendency to increase a few hundreds to 1000 or over 4000. As for the display drive circuit 1, or the display driver IC 10, a larger number of source amplifiers are arranged with the increase in the number of source lines and therefore, the source circuit 3 is laid out in a region elongated in a crosswise direction, and the gradation lines 22 are wired to be elongated in its crosswise direction as well. As described above, the rise in the degree of high definition of the display panel 90 increases the parasitic resistance of the gradation lines 22 and the parasitic capacitance thereof, worsens the capability of converging of gradation lines and consequently, causes a delay in the converging time of the source lines.

Referring to FIG. 2, the number of the preamplifiers 8, namely the number of the first gradation voltages is N (N is a positive integer), and the number of the gradation lines 22 for supplying second gradation voltages is noted as "M" in a generalized form. Further, while the gradation lines 22 are drawn as if they are wired on the automatic part circuit 11, the gradation lines 22 are wired taking roundabout routes. The reason for making the arrangement like this is to prevent noise from the automatic part circuit 11 from mixing in the gradation lines 22.

FIG. 1 is a block diagram showing an example of the configuration of the display drive circuit 1 and the display device 100 according to the first embodiment. The difference from the example of the configuration of a conventional display drive circuit 1 and a conventional display device 100 shown in FIG. 2 is as follows. The source circuit 3 is divided into a source circuit (of L side) 3_1 on the left and a source circuit (of R side) 3_2 on the right, and secondary resistance arrays ($2^{nd}$ strings) 2_1 and 2_2 are provided corresponding to the source circuits respectively. The left source circuit (of L side) 3_1 includes source amplifiers 4 (not shown) for driving left-side source lines 91_1 of the display panel 90 through terminals SL1 to SLx. The right source circuit (of R side) 3_2 includes source amplifiers 4 (not shown) for driving right-side source lines 91_2 of the display panel 90 through the terminals SR1 to SRx. Now, it is noted that x is a positive integer, and no special restriction is intended, but it is assumed for the diagrammatic representation that 2x=y holds. The secondary resistance array ($2^{nd}$ string) 2_1 supplies the left source circuit (of L side) 3_1 with secondary gradation voltages through the gradation lines 22_1 and 22_2. The secondary resistance array ($2^{nd}$ string) 2_2 supplies the right source circuit (of R side) 3_2 with secondary gradation voltages through the gradation lines 22_3 and 22_4. The secondary resistance arrays ($2^{nd}$ strings) 2_1 and 2_2 are supplied with primary gradation voltages from the gradation circuit 5 through N primary gradation voltage lines 21. For instance, the gradation circuit 5 includes a circuit as shown in FIG. 3. The detail thereof has been described above and therefore, the description on the example of the configuration thereof shall be omitted.

The two secondary resistance arrays ($2^{nd}$ strings) 2_1 and 2_2 are provided for the two source circuits 3_1 and 3_2 respectively and thus, the line lengths of the gradation lines 22_1 to 22_4 are largely shortened in comparison to those of the conventional gradation lines 22 shown in FIG. 2. Therefore, the time constants of lines extending from the preamplifiers 8_1 to 8_N to the source amplifiers 4 (not shown) are reduced as described later, and consequently the worsening of the capability of converging of the gradation lines 22_1 to 22_4 for supplying second gradation voltages to the source circuits 3_1 and 3_2 can be suppressed.

Now, it is noted that the numbers of the source amplifiers 4 included by the left and right source circuits 3_1 and 3_2 are roughly equal to each other. The secondary resistance arrays ($2^{nd}$ strings) 2_1 and 2_2 may be disposed in center portions in the widths of the source circuits 3_1 and 3_2 in a crosswise direction respectively. The gradation lines 22_1 and 22_2 are wired extending from the center portion of the left source circuit (of L side) 3_1 toward opposite ends, whereas the gradation lines 22_3 and 22_4 are wired extending from the center portion of the right source circuit (of R side) 3_2 toward opposite ends. The numbers of the source amplifiers 4 making loads, the line lengths of the gradation lines 22_1 to 22_4, namely parasitic resistances and parasitic capacitances are distributed uniformly. Therefore, the effect of suppressing the worsening of the capability of converging of the gradation lines 22 can be increased.

Capability of Converging of Gradation Lines

The effect of suppressing the worsening of the capability of converging of the gradation lines 22 will be described further in detail.

Figure 4:
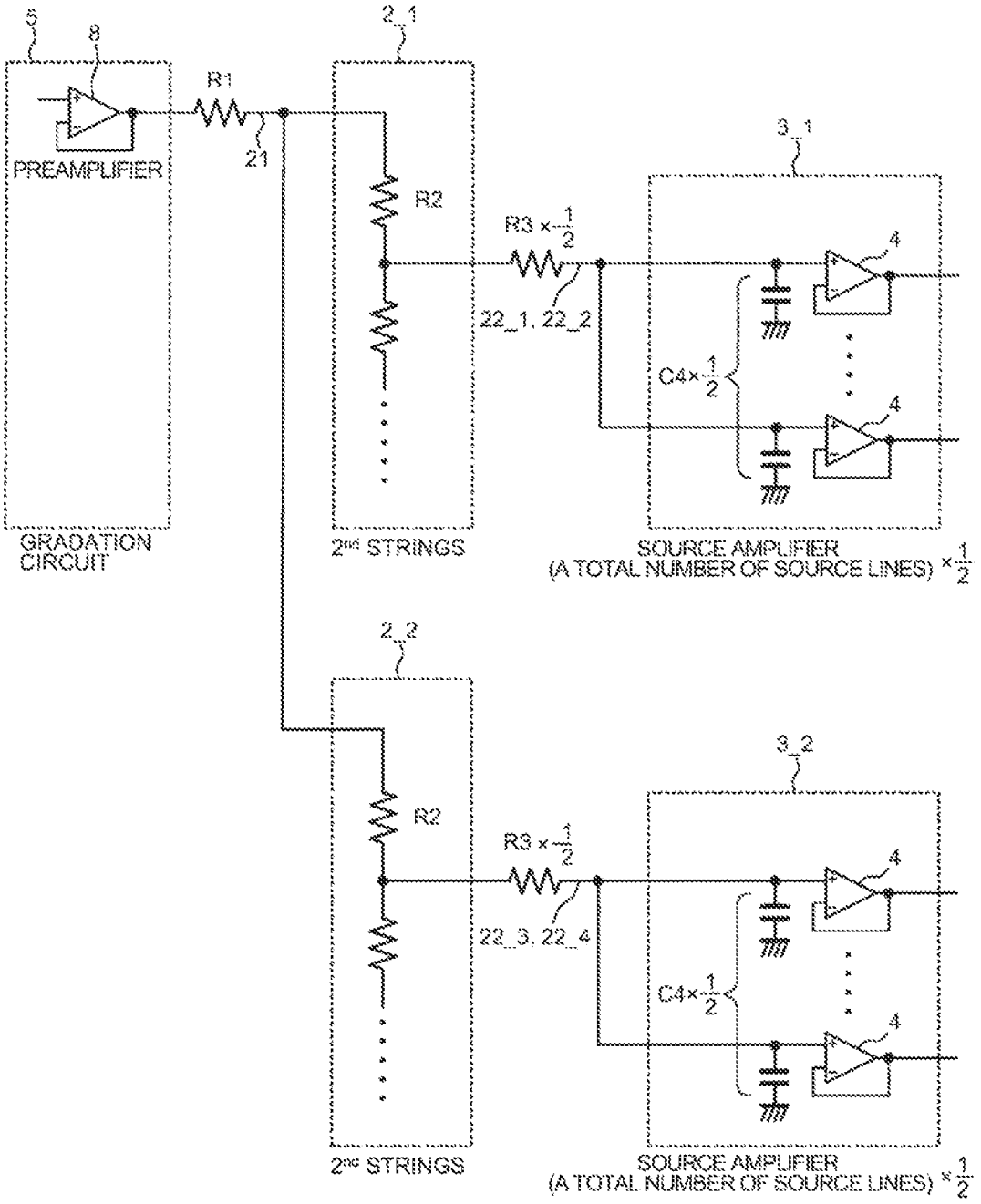
FIG. 4 is a diagram showing an equivalent circuit for calculating the time constant of each gradation line in the display drive circuit according to the first embodiment.
Figure 5:
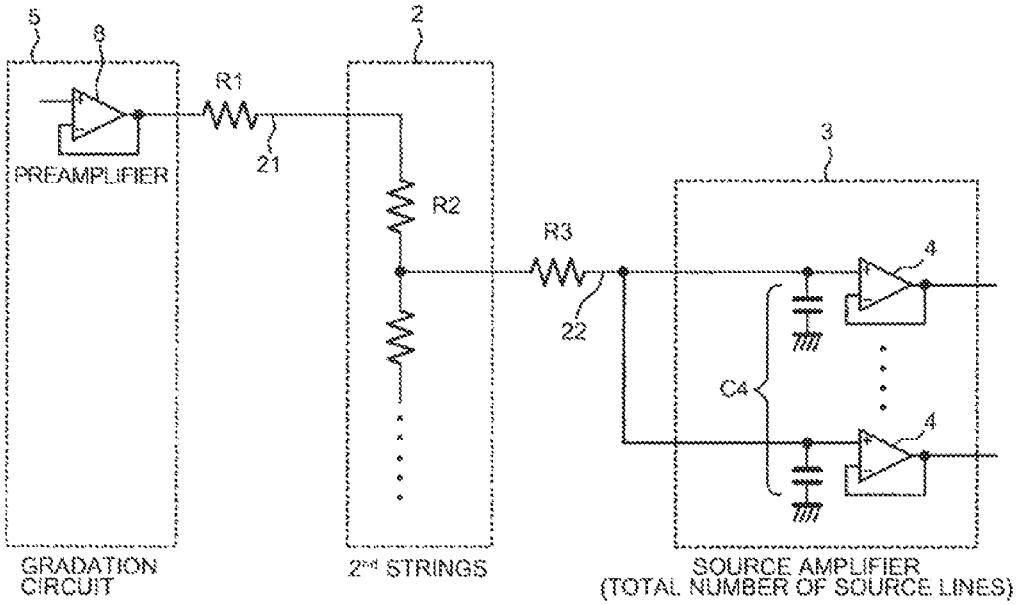
FIG. 5 is a diagram showing an equivalent circuit for calculating the time constant of each gradation line in the display drive circuit of the comparative example.

FIG. 4 is a diagram showing an equivalent circuit for calculating time constants of the gradation lines in the display drive circuit 1 (FIG. 1) according to the first embodiment. FIG. 5 is a diagram showing an equivalent circuit for calculating time constants of the gradation lines in the conventional display drive circuit 1 (FIG. 2) which is a comparative example. Each of FIGS. 4 and 5 show an equivalent circuit, in which line resistances of paths extending to the source amplifiers 4 included in the source circuit 3 are drawn with lumped constants, turning to a preamplifier 8, i.e. one of the preamplifiers 8_1 to 8_N included in the gradation circuit 5.

With reference to FIG. 5, the diagram shows an equivalent circuit of a conventional display drive circuit 1 (FIG. 2) which is a comparative example will be described first. In the diagram, the line resistance of the line 21 extending from the preamplifier 8 to taps of the secondary resistance array ($2^{nd}$ string) 2 is denoted by R1; a resistance in the $2^{nd}$ string 2 is denoted by R2; the line resistance of the line 22 extending from the $2^{nd}$ string 2 to each source amplifier 4 is denoted by R3; and a total input capacitance of the source amplifiers 4 is denoted by C4. The resistance R3 includes resistances produced by a switch, and the like, constituting a gradation-voltage-select circuit (not shown), which is calculated from the line length of the line 22 extending to each distributed capacitance C4. In this step, the time constant τ0 of a path extending from the preamplifier 8 to each source amplifier 4 is calculated by the following formula.

$$\tau 0=(R1+R2+R3)\times C4 \quad \text{(Formula 1).}$$

Next, the diagram showing an equivalent circuit of the display drive circuit 1 (FIG. 1) according to the first embodiment will be described with reference to FIG. 4. The line resistance of the line 21 extending from the preamplifier 8 to taps of the $2^{nd}$ strings 2_1 and 2_2 is denoted by R1 as in the case of the equivalent circuit shown in FIG. 5. As described above, in the display drive circuit 1 (FIG. 1) according to the first embodiment, the source circuit 3 is divided into the left source circuit (of L side) 3_1 and the right source circuit (of R side) 3_2; the secondary resistance arrays ($2^{nd}$ strings) 2_1 and 2_2 are provided corresponding to the left and right source circuits respectively. While the line 21 extending from the preamplifier 8 to the taps of the $2^{nd}$ strings 2_1 and 2_2 is longer than that in the comparative example shown in FIG. 2, the line resistance can be kept down as large as R1 by a method of widening the line in width or the like. The method is to be described later concretely. The line 21 is branched into lines extending to the $2^{nd}$ strings 2_1 and 2_2; the branch lines are wired to extend through the resistances R2 inside the $2^{nd}$ strings 2_1 and 2_2 to the source amplifiers 4. The line resistance of the lines 22_1 and 22_2 extending to the left source circuit (of L side) 3_1 is a half of the line resistance R3 in the comparative example. In the comparative example, the line resistance R3 is determined to have the maximum representing a line length of one half of the width of the source circuit 3 on condition that the $2^{nd}$ string 2 is disposed in a center portion in a width of the source circuit 3 in a long side direction thereof. In contrast, according to the first embodiment, the source circuit 3 is divided into the left and right ones, and additionally the corresponding $2^{nd}$ strings 2_1 and 2_2 can be disposed in center portions in the widths of the source circuits in the long side direction thereof. As a result, the line resistance R3 is determined to have the maximum representing a line length of a quarter of the width of the source circuit 3. Therefore, the line resistance in the equivalent circuit may be handled to be comparable to one half of the resistance R3 in the equivalent circuit of the comparative example shown in FIG. 5. Also, the input capacitances to the source amplifiers 4 are divided into left and right ones and therefore, each input capacitance becomes one half of C4, namely C4/2. From the foregoing, the time constant τ1 of each of paths extending from the preamplifier 8 to the source amplifiers 4 in the first embodiment can be calculated by:

$$\tau 1=(R1+R2+R3/2)\times C4/2 \quad \text{(Formula 2).}$$

In contrast to the time constant τ0 of the comparative example, as to the time constant τ1 of the first embodiment, the term of the resistance R3 is reduced to R3/2, and the capacitance C4 becomes one half thereof, whereby the display drive circuit is sped up, and the worsening of the capability of converging of gradation lines can be suppressed. Since the line 21 in the first embodiment is longer than that in the comparative example, an example in which a countermeasure to widen the line width of the line 21 or the like is used in order to prevent the increase in the line resistance has been shown here. However, even in case that the countermeasure like this is not taken and thus the resistance R1 is increased, the worsening of the capability of converging of gradation lines can be suppressed by lowering the whole time constant because of a large contribution of a component of one half the capacitance C4 resulting from the distribution of the capacitance C4.

Layout

As described above, in the display drive circuit 1 of the first embodiment shown in FIG. 1, the line length of the primary gradation voltage line 21 for supplying primary gradation voltages is longer than that in the conventional display drive circuit shown in FIG. 2. However, it is possible to suppress the worsening of the capability of converging of the gradation line 22 which is attributed to the line length of the primary gradation voltage line 21 increased by arranging the primary gradation voltage line 21 as a low-resistant line. For instance, the primary gradation voltage line 21 can be made a line larger in width than the secondary gradation voltage lines (gradation lines) 22_1 to 22_4. In general, the number N of the primary gradation voltage lines 21 is a fraction of the number M of the secondary gradation voltage lines (gradation lines) 22_1 to 22_4 and as such, the increase in layout area can be further suppressed by widening the primary gradation voltage lines 21 rather than widening, in line width, the secondary gradation voltage lines (gradation lines). In addition, it is also possible to form, by use of a wiring line material with lower resistivity, the primary gradation voltage line 21 in a wiring layer different from the layer with the secondary gradation voltage lines (gradation lines) 22 laid out in. For instance, the secondary gradation voltage lines (gradation lines) 22 may be formed by a wiring layer including aluminum as a primary component, and the primary gradation voltage lines 21 may be composed of wiring lines including copper as a primary component.

Figure 6:
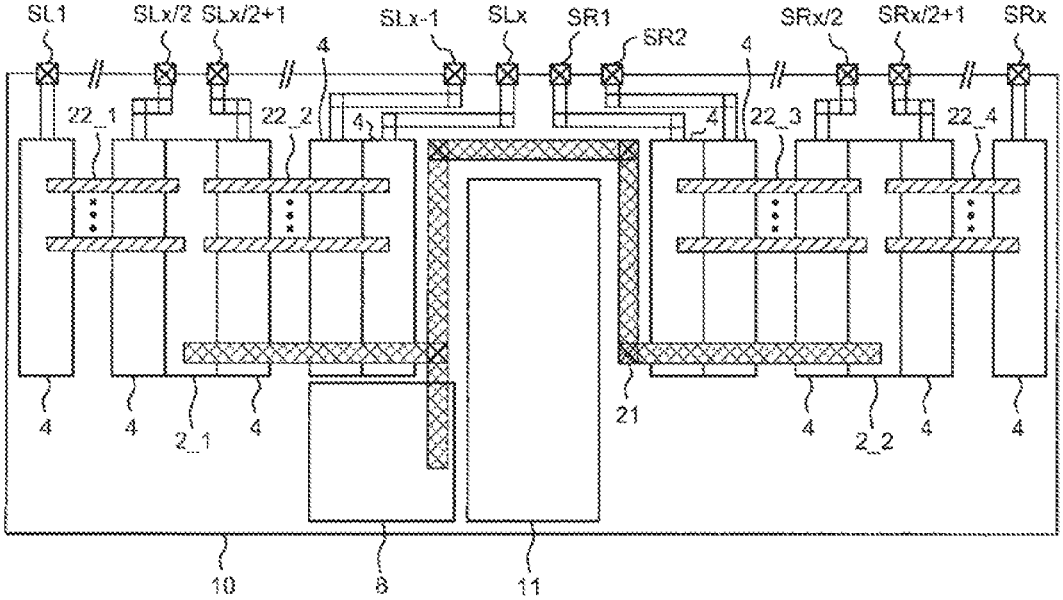
FIG. 6 is a schematic layout diagram showing an example of mounting of a display driver IC according to the first embodiment.

FIG. 6 is a schematic layout diagram showing an example of mounting of the display driver IC 10 according to the first embodiment. In the diagram, a chip layout near the source circuit 3 with the one-chip display driver IC 10 having the display drive circuit 1 mounted thereon is schematically represented. To avoid increasing complexity, a layout pattern of an active layer for elements used to constitute the source amplifiers 4, etc. are omitted, but only chief wiring layers are shown in the diagram. The source amplifiers 4 included in the left source circuit (of L side) 3_1 are arrayed from a center portion to the left along a long side of the display driver IC 10, and then wired to the pads SL1 to SLx respectively, whereas the source amplifiers 4 included in the right source circuit (of R side) 3_2 are arrayed from the center portion to the right along the long side of the display driver IC 10, and then wired to the pads SR1 to SRx respectively. The secondary resistance arrays ($2^{nd}$ strings) 2_1 and 2_2 are laid out at the same height as that the source amplifiers 4 is, and the secondary resistance arrays are disposed in center portions of the left and right source circuits 3_1 and 3_2 respectively. The gradation lines 22_1 to 22_4 for supplying second gradation voltages are commonly connected with the gradation-voltage-select circuit (not shown) connected with all the source amplifiers 4; the gradation lines 22_1 and 22_2 are wired extending from the left secondary resistance array ($2^{nd}$ string) 2_1 toward the opposing ends of the left source circuit (of L side) 3_1 in the left and right directions thereof, whereas the gradation lines 22_3 and 22_4 are wired extending from the right secondary resistance array ($2^{nd}$ string) 2_2 toward the opposing ends of the right source circuit (of R side) 3_2 in the left and right directions. The preamplifier 8 is disposed close to a center portion of the chip, from which the primary gradation voltage lines 21 are wired extending toward the left and right secondary resistance arrays ($2^{nd}$ strings) 2_1 and 2_2 respectively.

The primary gradation voltage lines 21 are arranged to be larger than the gradation lines 22_1 to 22_4 in line width, whereby the line resistance R1 shown in FIG. 4 can be made smaller. In general, the number N of the lines 21 for supplying first gradation voltages is as small as a fraction of the number M of the lines 22 for supplying second gradation voltages. On this account, the effect of suppressing the capability of converging of gradation lines, which is achieved by selectively making smaller the primary gradation voltage lines 21 in line resistance is larger even in consideration of the cost for a chip area, etc. which are necessary for the reduction in line resistance. As described above, the increase in chip area can be further suppressed in the case of achieving the reduction in line resistance by widening N primary gradation voltage lines 21 in line width rather than widening the M gradation lines 22_1 to 22_4 in line width.

In addition, the primary gradation voltage lines 21 may be arranged in a wiring layer different from a wiring layer to form the gradation lines 22_1 to 22_4 for supplying second gradation voltages in; a wiring line material having a lower resistance may be used for the primary gradation voltage lines 21, or the primary gradation voltage lines having a lower resistance may be arranged by use of a wiring layer larger in thickness. For instance, using the primary gradation voltage lines 21 composed of copper lines, the primary gradation voltage lines 21 of lower resistance can be arranged in comparison to the gradation lines 22_1 to 22_4 including a primary component of aluminum. In addition, it is also possible to achieve the reduction in resistance by increasing the thickness of the wiring layer. On condition that the wiring layer in which the primary gradation voltage lines 21 are formed is different from the wiring layer in which the gradation lines 22_1 to 22_4 are formed, the following means may be executed in appropriate combination: increasing the line width; increasing the wiring layer in thickness; and using a wiring line material having a lower resistance.

As a result of dividing the source circuit 3 into left and right source circuits, it becomes possible to lay out the automatic part circuit 11 in a region between the left and right source circuits 3_1 and 3_2 as shown in FIG. 6. According to the embodiment like this, the automatic part circuit 11 including a display-data-supply circuit operable to supply display data to the source circuits 3_1 and 3_2 can be laid out efficiently. The automatic part circuit 11 is a digital circuit, which is laid out in a collective region together with other digital circuits. In case that in the time of such layout, the automatic part circuit 11 is laid out in a long and narrow region, e.g. a rectangular region with a large aspect ratio in a long side direction of the display driver IC 10, the short side of the display driver IC 10 cannot be shortened. However, laying out the automatic part circuit 11 as shown in FIG. 6, the short side of the display driver IC 10 can be made shorter. The long side of the display driver IC 10 is disposed along the edge of the display panel 90, whereas its short side would affect the surroundings of the display panel 90 and a so-called frame size. Making shorter the short side of the display driver IC 10, it is possible to contribute to the narrower frame arrangement in the case of mounting the display driver IC 10 along a side of the display panel 90 in the display device 100.

In such a case, it is preferable to lay out the primary gradation voltage lines 21 to take roundabout routes avoiding surroundings of the automatic part circuit 11. The reason for making the arrangement like this is to prevent noise from the automatic part circuit 11 from mixing in the primary gradation voltage lines 21.

In general, digital signal lines extending from the automatic part circuit 11 to the left and the right are wired a region to lay out the source circuit 3 in. Even in the case of using the left and right source circuits in the first embodiment instead of the source circuit 3, the width of the source circuits is as large as several tens millimeters. Therefore, to transmit digital signals from a center portion to the left and right ends, it is necessary to provide a buffer (i.e. repeater buffer) on its way to each of the left and right ends to restore their signal levels. While such buffers are laid out and appropriately inserted in regions located at the same height between the source amplifiers 4, the buffer layout regions end up including an unused region because a repeater buffer for digital signals is a simple circuit in comparison to the source amplifiers 4. Leveraging unused regions of buffer layout regions to lay out each of the secondary resistance arrays ($2^{nd}$ strings) 2_1 and 2_2 on one region into which such unused regions are merged, the unused regions can be reduced to increase the layout efficiency.

Figure 7:
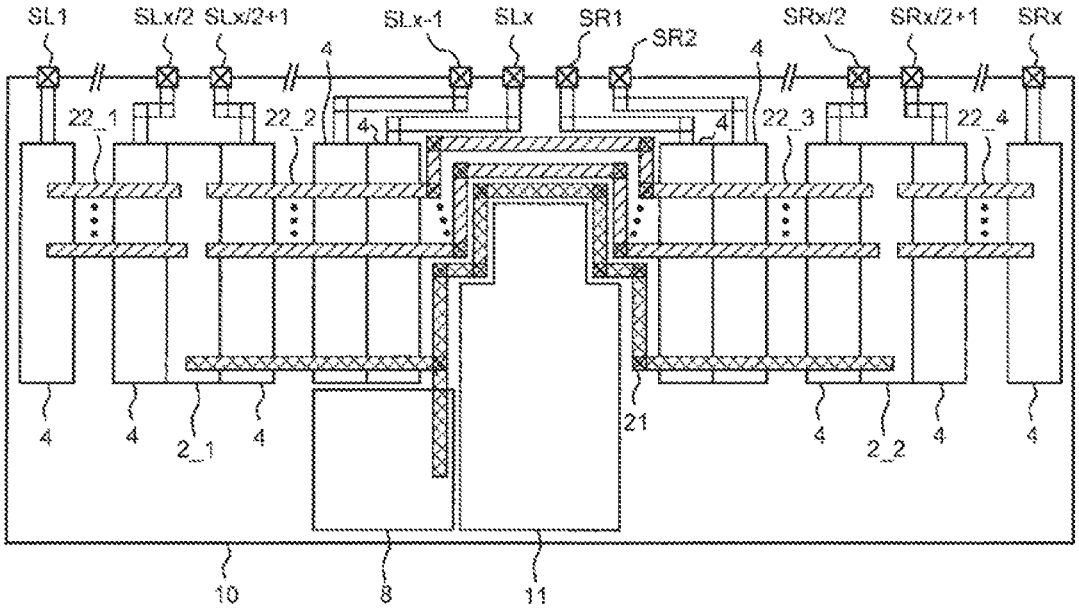
FIG. 7 is a schematic layout diagram showing another example of mounting of the display driver IC according to the first embodiment.

FIG. 7 is a schematic layout diagram showing another example of mounting the display driver IC 10 according to the first embodiment.

On condition that the source circuits 3 and the secondary resistance arrays ($2^{nd}$ strings) 2_1 and 2_2 corresponding to it are divided on the left and the right as in the first embodiment, error can be produced because second gradation voltages generated by the left and right $2^{nd}$ strings 2_1 and 2_2 are not necessarily identical with each other. The error arises as the difference in brightness between the left and right sides in the display panel 90. Since the first gradation voltages which are inputs to the $2^{nd}$ strings 2_1 and 2_2 are common, the error is very small and therefore, the difference in brightness between the left and right sides is very small as well. However, such difference is displayed as a boundary splitting a display screen into left and right parts and visually recognized with human eyes, resulting in the decline in display quality.

Hence, of the gradation lines 22_2 and 22_3 wired from the left and right $2^{nd}$ strings 2_1 and 2_2 toward the center portions, the gradation lines corresponding to each other are short-circuited as shown in FIG. 7. According to the embodiment like this, even in case that there is a potential difference between second gradation voltages generated by the left and right $2^{nd}$ strings 2_1 and 2_2, the occurrence of a steep difference in brightness can be avoided by smoothly connecting between the left and right sides of such difference. Since such difference in brightness is originally very small, the linear step disappears by smoothly connecting between the left and right sides of the difference and consequently, the decline in display quality can be prevented.

On condition that the source circuit 3 is divided into three or more, and secondary resistance arrays ($2^{nd}$ strings) 2 are provided on the resultant divisions respectively as described later (for the second embodiment), gradation lines 22 disposed adjacently to each other are short-circuited mutually between source circuits adjacent to each other. According to the embodiment like this, a steep difference in brightness can be prevented from arising at each boundary portion, and the decline in display quality can be prevented.

Second Embodiment

One Chip×Multiple Divisions

As to the first embodiment, the display drive circuit 1 has been described chiefly, which includes: a left source circuit (of L side) 3_1 and a right source circuit (of R side) 3_2 arranged by dividing the source circuit 3 in two; and two secondary resistance arrays ($2^{nd}$ strings) 2_1 and 2_2 provided corresponding to the two source circuits. On the other hand, the source circuit 3 may be divided in more than two, and secondary resistance arrays 2 of the same number corresponding to the more than two divisions may be provided.

Figure 8:
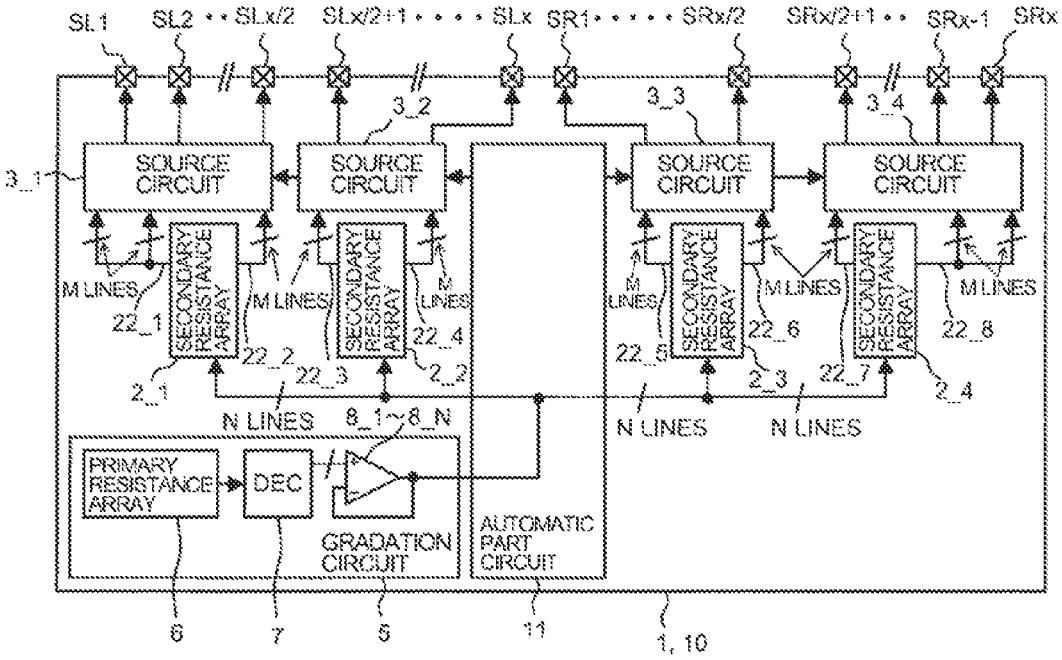
FIG. 8 is a block diagram showing an example of the configuration of a display drive circuit according to the second embodiment.

FIG. 8 is a block diagram showing an example of the configuration of the display drive circuit 1 according to the second embodiment. This is an example of the source circuit 3 divided in four. The display drive circuit 1 is formed on a single semiconductor substrate. The display drive circuit 1 may be materialized as a display driver IC 10. The display drive circuit 1 or display driver IC 10 includes: a gradation circuit 5; an automatic part circuit 11; source circuits 3_1 to 3_4, arranged by dividing the source circuits 3 in four; and secondary resistance arrays ($2^{nd}$ strings) 2_1 to 2_4 provided corresponding to the source circuits respectively. The gradation circuit 5 and the automatic part circuit 11 are as described concerning the first embodiment with reference to FIG. 2 and therefore, their descriptions are omitted here. The source circuits 3_1 to 3_4 are arranged by dividing the source circuit 3 into left and right parts, and then further dividing each of the left and right parts in two. It is preferable that the source circuits 3_1 to 3_4 each include source amplifiers (subjected to the equal division), and they are identical with each other in the number of source amplifiers. The source circuit 3_1 is connected with the source lines through terminals SL1 to SLx/2; the source circuit 3_2 is connected with the source lines through terminals SLx/2+1 to SLx, the source circuit 3_3 is connected with the source lines through terminals SR1 to SRx/2; and the source circuit 3_4 is connected with the source lines through terminals SRx/2+1 to SRx. The source circuits 3_1 to 3_4 output drive signals to the source lines connected therewith respectively. The $2^{nd}$ strings 2_1 to 2_4 are provided corresponding to the source circuits 3_1 to 3_4. It is preferable to dispose the $2^{nd}$ strings 2_1 to 2_4 in center portions of the source circuits 3_1 to 3_4 (i.e. center portions in their long side directions). From the $2^{nd}$ string 2_1, a set of gradation lines 22_1 and 22_2 is wired to extend toward left and right ends of the source circuit 3_1. Likewise, from the $2^{nd}$ strings 2_2 to 2_4, a set of gradation lines 22_3 and 22_4, a set of gradation lines 22_5 and 22_6, and a set of gradation lines 22_7 and 22_8 are wired to extend toward left and right ends of the corresponding source circuits 3_2 to 3_4 respectively. The gradation lines 22_1 to 22_8 can be arranged to have the same line length by the equal division in four on the source circuit 3, and disposing the $2^{nd}$ strings 2_1 to 2_4 in center portions of the source circuits respectively. Here, the representations such as "center", "same" or "equal" do not imply correctly so with high accuracy and correctness, but they imply "roughly center", "roughly the same" or "roughly equal".

While the example in which the source circuit 3 is divided in four is shown in FIG. 8, the display drive circuit 1 or the display driver IC 10 can be likewise arranged even with a division number of 3, 5 or larger.

Capability of Converging of Gradation Lines

The effect of suppressing the worsening of the capability of converging of the gradation lines 22 will be described further in detail.

Figure 9:
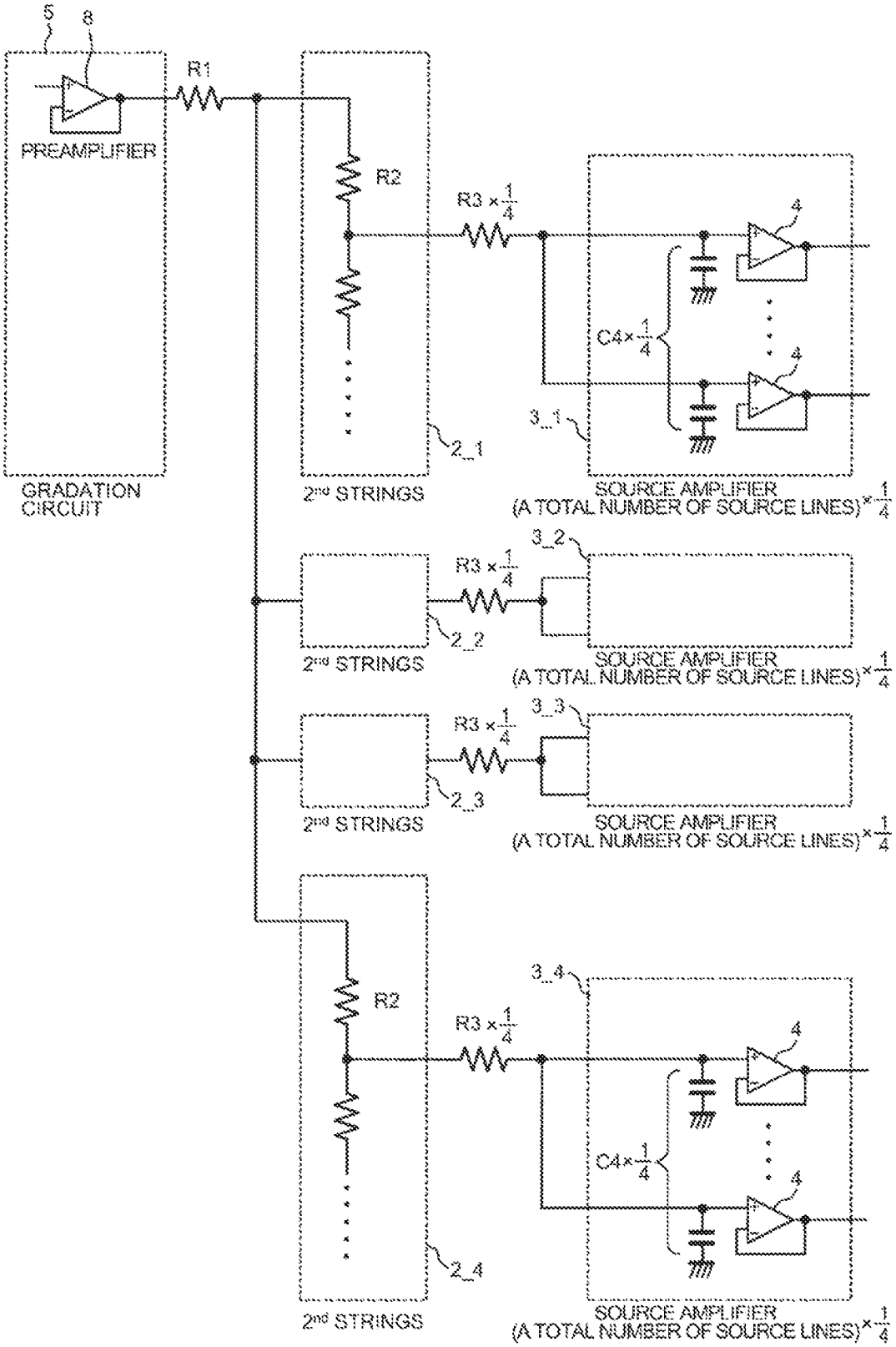
FIG. 9 is a diagram showing an equivalent circuit for calculating the time constant of each gradation line in the display drive circuit according to the second embodiment.

FIG. 9 is a diagram showing an equivalent circuit for calculating the time constant of each gradation line 22 in the display drive circuit 1 (FIG. 8) according to the second embodiment. As described above with reference to FIGS. 4 and 5, FIG. 9 shows an equivalent circuit, in which line resistances of paths extending to the source amplifiers 4 included in the source circuit 3 are drawn with lumped constants, turning to a preamplifier 8, i.e. one of preamplifiers 8_1 to 8_N included in the gradation circuit 5. The equivalent circuit shown in FIG. 9 is different from the equivalent circuits shown in FIGS. 4 and 5 in that the wiring line 21 is branched into lines extending to the $2^{nd}$ strings 2_1 to 2_4; the branch lines are wired to extend through the resistances R2 inside the $2^{nd}$ strings to the source circuits 3_1 to 3_4, and wired to the source amplifiers 4. The line resistance of the line 21 extending from the preamplifier 8 to taps of the $2^{nd}$ strings 2_1 to 2_4 is made R1 which is the same as those in FIGS. 4 and 5. This is because the equivalent circuit of FIG. 9 is different in the line path and the line length, and the line resistances vary depending on the paths, but they can be made the same value by adjustment of their line widths, as described above.

The line resistances R3 are each a quarter of that of the equivalent circuit of the comparative example shown in FIG. 5. In addition, the input capacitance of each source amplifier 4 is divided in four and as such, each input capacitance becomes C4/4. From the foregoing, the time constant τ2 of each of paths extending from the preamplifier 8 to the source amplifiers 4 in the second embodiment can be calculated by:

$$\tau 2=(R1+R2+R3/4)\times C4/4 \quad \text{(Formula 3).}$$

Making a comparison to the time constant τ0 of the comparative example, the term of the resistance R3 is reduced, and the capacitance C4 is made a quarter thereof, whereby the display drive circuit is sped up, and the worsening of the capability of converging of gradation lines is suppressed. Even when making a comparison to the time constant τ1 of the first embodiment, the resistance R3 is further reduced from a half to a quarter, and the capacitance C4 is further reduced from a half to a quarter, and thus the time constant τ2 becomes smaller, and the worsening of the capability of converging of gradation lines is further suppressed. The effect can be expected as well even in the case of dividing the source circuit 3 in four or more. That is, the larger the division number is, the further the worsening of the capability of converging of the gradation lines can be suppressed.

Third Embodiment

Two Chips

While the first and second embodiments have been described chiefly on the cases in which the display drive circuit 1 is formed on a single semiconductor substrate and materialized in the form of a one-chip display driver IC 10, the invention may be embodied by multiple chips. The third embodiment will be described chiefly on the case of division into two chips, which can be applied to cases of division into more than two chips in the same way.

Figure 10:
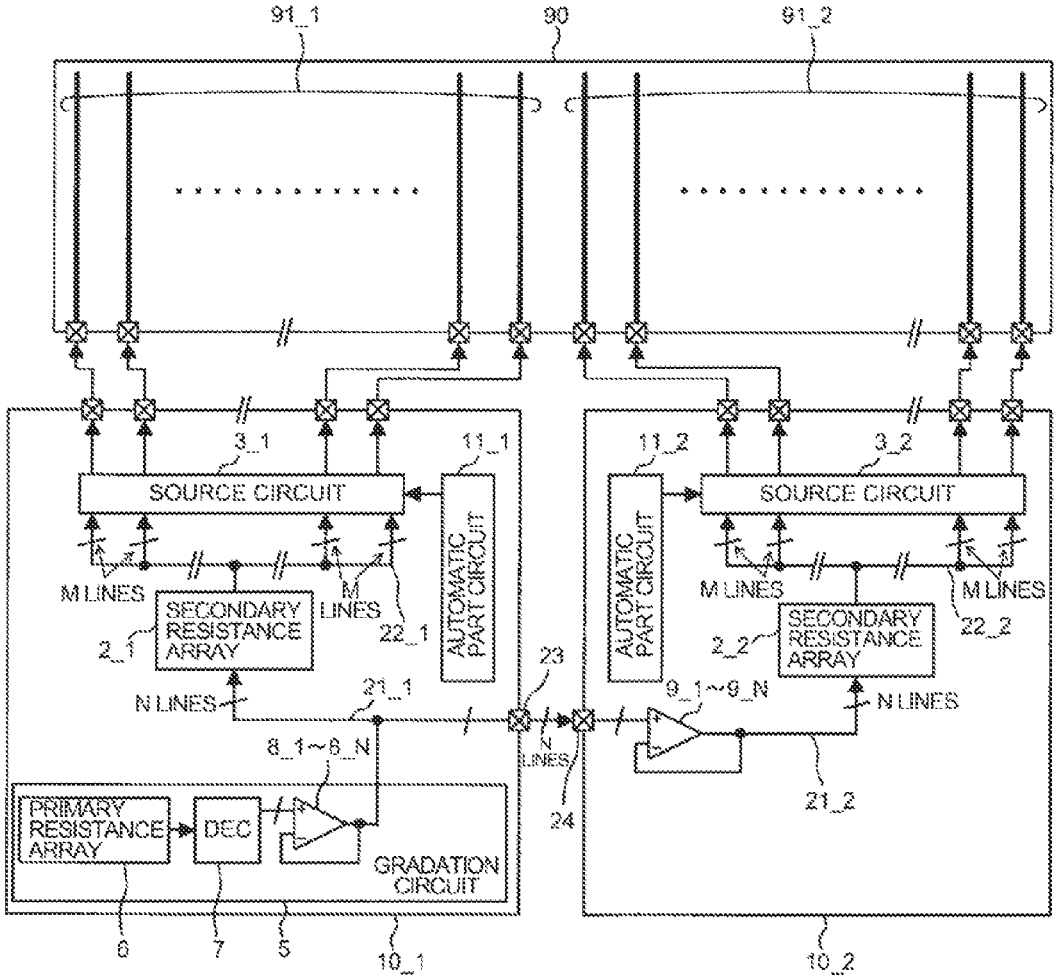
FIG. 10 is a block diagram showing an example of the configuration of a display drive circuit of a two-chip structure and a display device arranged by use thereof as a comparative example.
Figure 11:
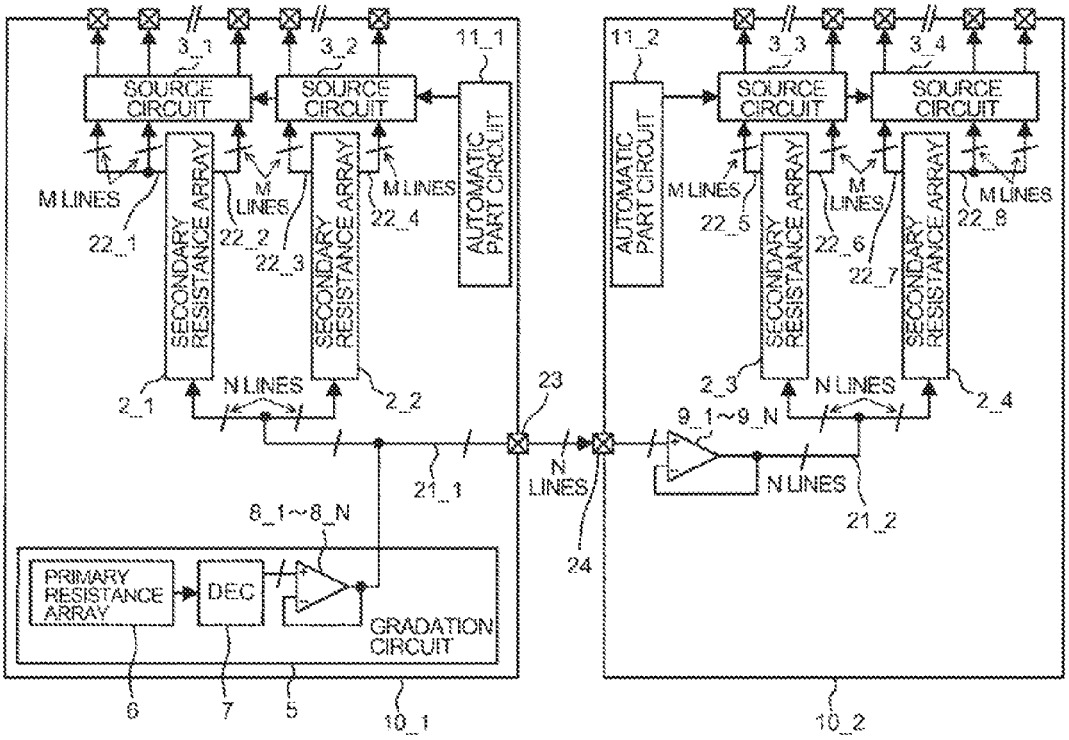
FIG. 11 is a block diagram showing an example of the configuration of a display drive circuit according to the third embodiment.

FIG. 10 is a block diagram showing an example of the configuration of a display drive circuit 1, which is a comparative example of a conventional two-chip structure, and a display device 100 arranged by use thereof. FIG. 11 is a block diagram showing an example of the configuration of the display drive circuit 1 according to the third embodiment.

The structure of a conventional display device 100 which is a comparative example shown in FIG. 10 will be described first. The display device 100 includes: a display panel 90; a master display driver IC 10_1; and a slave display driver IC 10_2. The source lines 91_1 and 91_2 of the display panel 90 are connected with the master and slave display driver ICs 10_1 and 10_2 and driven respectively.

The master display driver IC 10_1 includes: a gradation circuit 5; a secondary resistance array ($2^{nd}$ string) 2_1; a source circuit 3_1; and an automatic part circuit 11_1. The gradation circuit 5 includes a primary resistance array ($1^{st}$ string) 6, a decoder 7, and preamplifiers 8_1 to 8_N, as described concerning the first embodiment. The gradation circuit 5 supplies primary gradation voltages output by the preamplifiers 8_1 to 8_N to the secondary resistance array ($2^{nd}$ string) 2_1 through N primary gradation voltage lines 21_1. The secondary resistance array ($2^{nd}$ string) 2_1 further divides the primary gradation voltages to produce secondary gradation voltages, and supplies them to the source circuit 3_1 through the gradation line 22_1. Also, the primary gradation voltages output by the gradation circuit 5 are output to the slave display driver IC 10_2 through a terminal 23.

The slave display driver IC 10_2 includes: preamplifiers 9_1 to 9_N; a secondary resistance array ($2^{nd}$ string) 2_2; a source circuit 3_2; and an automatic part circuit 11_2. Primary gradation voltages supplied by the master display driver IC 10_1 are input to the slave display driver IC 10_2 through a terminal 24, passed through the preamplifiers 9_1 to 9_N, and then supplied to the secondary resistance array ($2^{nd}$ string) 2_2 through N primary gradation voltage lines 21_2. The secondary resistance array ($2^{nd}$ string) 2_2 further divides the primary gradation voltages to produce secondary gradation voltages, and supplies them to the source circuit 3_2 through the gradation line 22_2.

FIG. 11 is a block diagram showing an example of the configuration of the display drive circuit 1 according to the third embodiment. The display drive circuit 1 of FIG. 11 is different from the conventional display drive circuit 1 shown in FIG. 10 in that the source circuit 3 is divided in two in each of the master and slave display driver ICs 10_1 and 10_2, and two secondary resistance arrays ($2^{nd}$ strings) 2_1 to 2_4 are provided corresponding to the source circuits respectively.

The master display driver IC 10_1 includes: a gradation circuit 5; secondary resistance arrays ($2^{nd}$ strings) 2_1 and 2_2; source circuits 3_1 and 3_2; and an automatic part circuit 11_1. The gradation circuit 5 and the automatic part circuit 11_1 are the same as those in the comparative example shown in FIG. 10 and therefore, the descriptions thereof are omitted here. Primary gradation voltages output by the gradation circuit 5 are supplied to the $2^{nd}$ strings 2_1 and 2_2 through a primary gradation voltage line 21_1. The $2^{nd}$ string 2_1 supplies secondary gradation voltages to the source circuit 3_1 through gradation lines 22_1 and 22_2. The $2^{nd}$ string 2_2 supplies secondary gradation voltages to the source circuit 3_2 through gradation lines 22_3 and 22_4. Primary gradation voltages output by the gradation circuit 5 are output to the slave display driver IC 10_2 through a terminal 23.

The slave display driver IC 10_2 includes: preamplifiers 9_1 to 9_N; secondary resistance arrays ($2^{nd}$ strings) 2_3 and 2_4; source circuits 3_3 and 3_4; and an automatic part circuit 11_2. The preamplifiers 9_1 to 9_N and the automatic part circuit 11_2 are the same as those in the comparative example shown in FIG. 10 and therefore, the descriptions thereof are omitted here. Primary gradation voltages supplied from the master display driver IC 10_1 are input to the slave display driver IC 10_2 through a terminal 24, and then passed through the preamplifiers 9_1 to 9_N, and then supplied to the secondary resistance arrays ($2^{nd}$ strings) 2_3 and 2_4 through N primary gradation voltage lines 21_2. Each of the $2^{nd}$ strings 2_3 and 2_4 further divides the primary gradation voltages to produce secondary gradation voltages, supplies them to the source circuit 3_3 through gradation lines 22_5 and 22_6, and supplies them to the source circuit 3_4 through gradation lines 22_7 and 22_8.

The source circuit 3 is divided into four source circuits, in which the source circuit 3 is first divided in two for the master and slave display driver ICs 10_1 and 10_2, and then further divided in two for the left and right in each display driver IC. Accordingly, four secondary resistance arrays ($2^{nd}$ strings) 2_1 to 2_4 are provided corresponding to the source circuits 3_1 to 3_4 respectively. As a result, the gradation lines 22_1 to 22_8 are widely shortened in line length in comparison to the conventional gradation lines 22_1 and 22_2 shown in FIG. 10. Thus, as described later, the time constant of each of lines extending from the preamplifiers 8_1 to 8_N to the source amplifiers 4 (not shown) is reduced, and the worsening of the capability of converging of the gradation lines 22_1 to 22_8 can be suppressed.

It is possible to mount, on a display device, a display drive circuit of a two-chip or multiple-chip structure which includes two or more display driver ICs 10 of one type having both of the function of the master display driver IC 10_1 and the function of the slave display driver IC 10_2, and arranged to be able to switch the functions appropriately. According to the embodiment like this, the following are made possible: suppressing the increase in the number of types of ICs to develop; and keeping down the development cost of ICs.

Capability of Converging of Gradation Lines

The effect of suppressing the worsening of the capability of converging of the gradation line 22 will be described further in detail.

Figure 12:
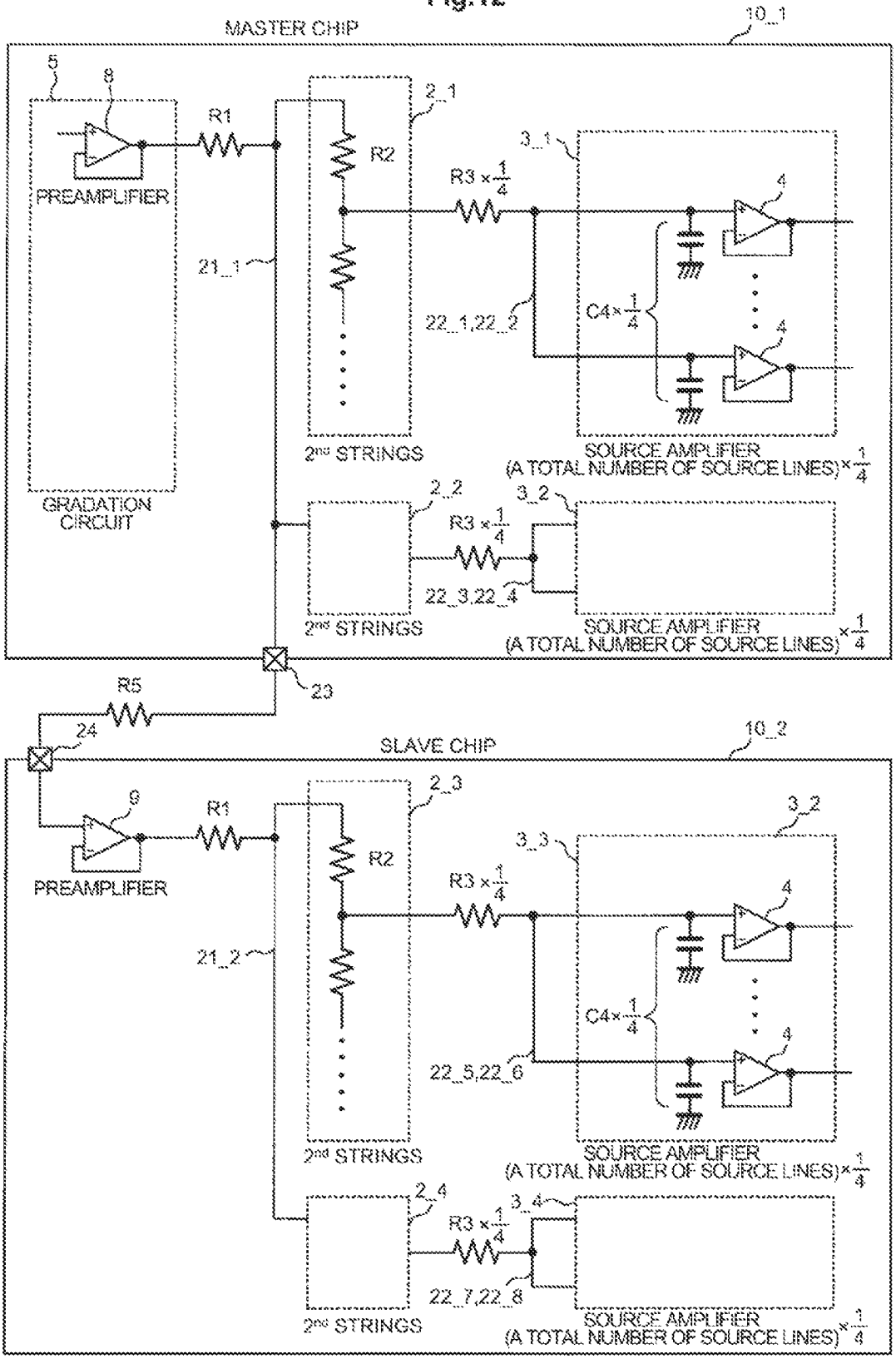
FIG. 12 is a diagram showing an equivalent circuit for calculating the time constant of each gradation line in the display drive circuit according to the third embodiment.
Figure 13:
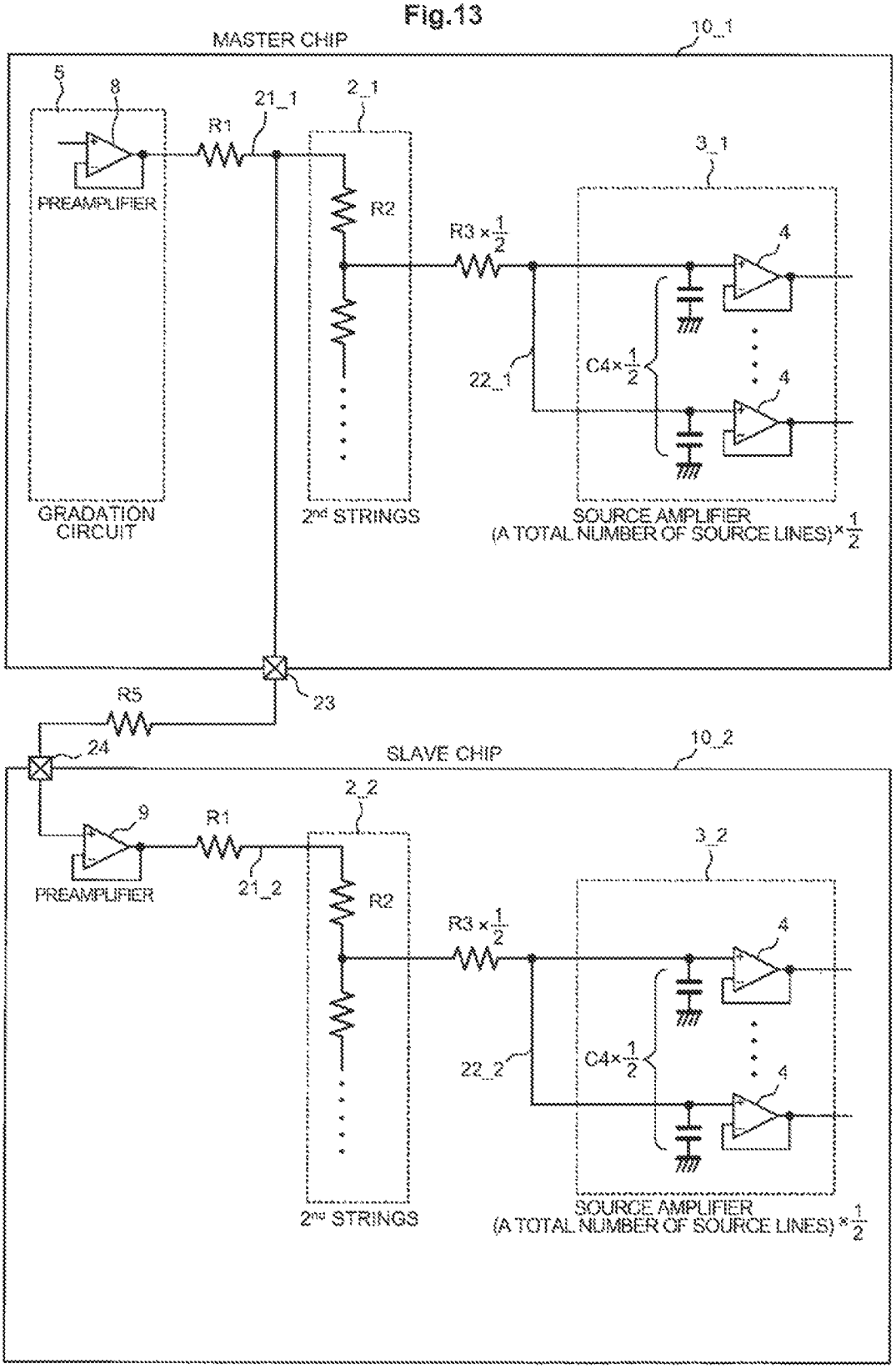
FIG. 13 is a diagram showing an equivalent circuit for calculating the time constant of each gradation line in a display drive circuit which is a comparative example of the two-chip structure.

FIG. 12 is a diagram showing an equivalent circuit for calculating the time constant of each gradation line in the display drive circuit 1 (see FIG. 11) according to the third embodiment. FIG. 13 is a diagram showing an equivalent circuit for calculating the time constant of each gradation line in the display drive circuit 1 (FIG. 10) which is a comparative example thereof. As described above with reference to FIGS. 4, 5 and 9, FIGS. 12 and 13 each show an equivalent circuit, in which line resistances of paths extending to the source amplifiers 4 included in the source circuit 3 are drawn with lumped constants, turning to a preamplifier 8, i.e. one of preamplifiers 8_1 to 8_N included in the gradation circuit 5.

The diagram showing an equivalent circuit shown in FIG. 13 in connection with the conventional display drive circuit 1 (FIG. 10) which is a comparative example will be explained first. In the master display driver IC 10_1, the line resistance of the line 21_1 extending from the preamplifier 8 to taps of the secondary resistance array ($2^{nd}$ string) 2_1 is R1; a resistance in the $2^{nd}$ string 2_1 is R2; the line resistance of the line 22_1 extending from the $2^{nd}$ string 2_1 to the source amplifiers 4 in the source circuit 3_1 is R3/2; and a total input capacitance of the source amplifiers 4 is C4/2. The first gradation voltages are transmitted from the master display driver IC 10_1 to the slave side through a resistance R5. In the slave display driver IC 10_2, the first gradation voltages are passed through the preamplifier 9, and supplied to the $2^{nd}$ string 2_2 through the line 21_2. The line resistance of the line 21_2 is also R1 which is the same as that on the master side. The paths from the $2^{nd}$ string 2_2 to source amplifiers 4 in the source circuit 3_2 are the same as those on the master side. The resistances in the $2^{nd}$ string 2_2 are R2; and the line resistance of the line 22_2 extending from the $2^{nd}$ string 2_2 to the source amplifiers 4 in the source circuit 3_2 is R3/2. The total of input capacitances of the source amplifiers 4 is C4/2. In the case of the comparative example shown in FIG. 4, the source circuit 3 is not divided; in the cases of FIGS. 10 and 13, the source circuits are divided in two for the master and slave sides. Therefore, total input capacitances of the source amplifiers 4 are each C4/2. Each of the source circuits 3_1 and 3_2 can be laid out on a region having a half width as large as one-half of the width of the source circuit 3, which is not divided and is shown in FIG. 2. Therefore, the lines 22_1 and 22_2 both have one half the length of the line 22 in the case of the source circuit 3 shown in FIG. 2, which is not divided. On this account, each line resistance of the lines 22_1 and 22_2 is R3/2 which represents one half of that of the line 22 in case that the source circuit is not divided.

In such case, the time constant τ3 of the path extending from the preamplifier 8 of the master display driver IC 10_1 to the source amplifiers 4 can be calculated by:

$$\tau 3=(R1+R2+R3/2)\times C4/2 \quad \text{(Formula 4).}$$

The time constant τ4 of the path extending from the preamplifier 8 of the master display driver IC 10_1 to the source amplifier 4 when viewed from the slave display driver IC 10_2 can be calculated by:

$$\tau 4=(R1\times 2+R2+R3/2+R5)\times C4/2 \quad \text{(Formula 5).}$$

Next, the diagram showing an equivalent circuit in connection with the display drive circuit 1 (FIG. 11) according to the third embodiment will be explained referring to FIG. 12. In the master display driver IC 10_1, the line resistance of the line 21_1 extending from the preamplifier 8 to taps of the $2^{nd}$ strings 2_1 and 2_2 is denoted by R1 as in the equivalent circuit shown in FIG. 13. The line 21_1 is branched into lines to the $2^{nd}$ strings 2_1 and 2_2, which are passed through the resistances R2 in the $2^{nd}$ strings 2_1 and 2_2 respectively, and wired to the source amplifiers 4 in the source circuits 3_1 and 3_2. Each of the line resistances of the lines 22_1 to 22_4 extending to the source circuits 3_1 and 3_2 is a quarter the line resistance R3 in the comparative example shown in FIG. 4. In addition, each of input capacitances of the source amplifiers 4 is C4/4. This is because the source circuits are divided in two for the master and the slave, and then further divided in two for the left and the right. In the slave display driver IC 10_2, primary gradation voltages are passed through the preamplifier 9, and supplied to the $2^{nd}$ strings 2_3 and 2_4 through the line 21_2. The line resistance of the line 21_2 is made R1 which is the same as that in the master side. The paths extending from the $2^{nd}$ strings 2_3 and 2_4 to the source amplifiers 4 in the source circuits 3_3 and 3_4 are the same as those in the master side. The resistances in the $2^{nd}$ strings 2_3 and 2_4 are each R2; the line resistances of lines 22_5 to 22_8 extending from the $2^{nd}$ strings 2_3 and 2_4 to source amplifiers 4 in the source circuits 3_3 and 3_4 are each a quarter of the line resistance R3 in the comparative example shown in FIG. 4. Also, the input capacitances of the source amplifiers 4 are each C4/4. This is because the source circuits are divided in two for the master and the slave, and then further divided in two, namely into left and right ones.

In this step, the time constant τ5 of the path extending from the preamplifier 8 of the master display driver IC 10_1 to the source amplifiers 4 at this time can be calculated by:

$$\tau 5=(R1+R2+R3/4)\times C4/4 \quad \text{(Formula 6).}$$

In addition, the time constant τ6 of a path extending from the preamplifier 8 of the master display driver IC 10_1 to the source amplifier 4 when viewed from the slave display driver IC 10_2 can be calculated by:

$$\tau 6=(R1\times 2+R2+R3/4+R5)\times C4/4 \quad \text{(Formula 7).}$$

Comparing the time constants τ3 and τ4 in a comparative example in the case of the two-chip structure as shown in FIGS. 10 and 13 with the time constants τ5 and τ6 of the third embodiment shown in FIGS. 11 and 12, the term of the resistance R3 reduces from R3/2 to R3/4, and the capacitance decreases from C4/2 to C4/4, and the time constant decreases, and the worsening of the capability of converging of gradation lines is suppressed. As described above, even if the display drive circuit 1 is constituted by use of display driver ICs 10, it is possible to suppress the worsening of the capability of converging of gradation lines as well.

While the invention made by the inventor has been concretely described above based on the embodiments, the invention is not so limited. It is obvious that various changes and modifications may be made without departing from the subject matter hereof.

For instance, as to the display device 100 based on the two-chip structure in the third embodiment, a form having master and slave display driver ICs for transmitting gradation voltages generated by the master side to the slave side has been described, whereas a form of each chip including a gradation-voltage-generation circuit without discriminating between a master and a slave is also possible. In this case, an arrangement is made so that gradation voltages generated by two display driver ICs are matched with each other by a known art or an invention which is independent of the invention hereof.

What is claimed is:

1. A display drive circuit, comprising:

a plurality of source amplifiers operable to drive source lines of a display panel;

a plurality of preamplifiers operable to output first gradation voltages;

a plurality of source circuits, each source circuit including a portion of the plurality of source amplifiers and extending with a respective width along a first direction;

a plurality of resistance arrays corresponding to the plurality of source circuits, the plurality of resistance arrays operable to divide the plurality of first gradation voltages to generate a plurality of second gradation voltages, wherein each resistance array of the plurality of resistance arrays is operable (1) to divide a respective one of the first gradation voltages to generate a respective second gradation voltage of the plurality of second gradation voltages, and (2) supply the respective second gradation voltage to only a source circuit of the plurality of source circuits that corresponds to the resistance array generating the second gradation voltage; and gradation lines wired from each resistance array to opposing ends of the corresponding source circuit, the opposing ends being relative to the first direction, wherein each source circuit includes a substantially equal number of source amplifiers of the plurality of source amplifiers, wherein the source amplifiers of the plurality of source amplifiers are arrayed along the first direction, wherein each resistance array of the plurality of resistance arrays is disposed in a substantially center portion of a corresponding source circuit along the first direction, and wherein each gradation line of the gradation lines is determined to have a maximum resistance corresponding to a line length of one-half the width of the corresponding source circuit.

2. The display drive circuit of claim 1, further comprising:

a gradation circuit including a circuit operable to generate the first gradation voltages and including the plurality of preamplifiers, wherein two resistance arrays of the plurality of resistance arrays supply the second gradation voltages to two corresponding source circuits of the plurality of source circuits, wherein the gradation circuit, the two source circuits, and the two resistance arrays are formed on a single semiconductor substrate, wherein each resistance array of the two resistance arrays are is disposed in a substantially center portion of a corresponding source circuit of the two source circuits along the first direction, wherein gradation lines are wired from each resistance array of the two resistance arrays to opposing ends of the corresponding source circuit along the first direction, and wherein each gradation line of the gradation lines is determined to have a maximum resistance corresponding to a line length of one-half the width of the corresponding source circuit.

3. The display drive circuit of claim 2, wherein a gradation line wired to a first source circuit of the two source circuits is electrically connected with a gradation line wired from a second source circuit of the two source circuits to the first source circuit.

4. The display drive circuit of claim 2, wherein the gradation circuit is arranged to output the first gradation voltages to components outside of a chip that includes the plurality of source amplifiers.

5. The display drive circuit of claim 2, wherein:

the gradation circuit is arranged so that the first gradation voltages can be input from components outside of a chip that includes the plurality of source amplifiers, and the plurality of preamplifiers is operable to generate internal first gradation voltages based on the first gradation voltages input from outside the chip and supply the internal first gradation voltages to the resistance arrays.

6. The display drive circuit of claim 2, further comprising:

a display-data-supply circuit, wherein the display-data-supply circuit is operable to supply input display data to corresponding source circuits, wherein a source circuit of the plurality of source circuits includes a gradation-voltage-select circuit operable to generate, from the second gradation voltages, analog voltages corresponding to the input display data based on supplied display data, and supply the analog voltages to the plurality of source amplifiers, and wherein the display-data-supply circuit is disposed between the two source circuits of the plurality of source circuits.

7. The display drive circuit of claim 1, further comprising:

a gradation circuit including a circuit operable to generate the first gradation voltages and including the plurality of preamplifiers, wherein one or more resistance arrays of the plurality of resistance arrays supply the second gradation voltages to corresponding source circuits, wherein the gradation circuit, the source circuits of the plurality of source circuits, and the one or more resistance arrays of the plurality of resistance arrays are formed on a single semiconductor substrate, wherein the resistance arrays of the plurality of resistance arrays are each disposed in a substantially center portion of a corresponding source circuit in the first direction, and wherein gradation lines are wired from each resistance array of the plurality of resistance arrays to opposing ends of a corresponding source circuit in the first direction.

8. The display drive circuit of claim 7, wherein:

the plurality of source circuits includes a first source circuit and a second source circuit adjacent to the first source circuit, and a gradation line wired to the first source circuit is electrically connected with a gradation line wired from the second source circuit to the first source circuit.

9. The display drive circuit of claim 1, wherein each source circuit of the plurality of source circuits includes a group of digital signal lines extending in the first direction and at least one group of buffers for restoring signal levels of the group of digital signal lines, and wherein the group of buffers is disposed in a region with opposing ends in contact with the plurality of source amplifiers.

10. The display drive circuit of claim 1, wherein:

a line resistance per unit length of a line for supplying the first gradation voltages to the plurality of resistance arrays from the plurality of preamplifiers is lower than a line resistance per unit length of lines for supplying the second gradation voltages.

11. The display drive circuit of claim 10, wherein a line width of the line for supplying the first gradation voltages is wider than a line width of a line for supplying the second gradation voltages.

12. A display device, comprising:

a display panel having a plurality of source lines; and a display drive circuit connected with the display panel, the display drive circuit comprising:

a plurality of source amplifiers configured to drive the plurality of source lines;

a plurality of preamplifiers operable to output first gradation voltages;

a plurality of source circuits including divisions of the plurality of source amplifiers, each source circuit of the plurality of source circuits extending with a respective width along a first direction;

a plurality of resistance arrays corresponding to the plurality of source circuits, the plurality of resistance arrays operable to divide the plurality of first gradation voltages to generate a plurality of second gradation voltages, wherein each resistance array of the plurality of resistance arrays is operable to (1) divide a respective one of the first gradation voltages to generate a respective second gradation voltage of the plurality of second gradation voltages, and (2) supply the respective second gradation voltage to only a source circuit of the plurality of source circuits that corresponds to the resistance array generating the second gradation voltage; and a gradation circuit operable to generate the first gradation voltages, the gradation circuit comprising the plurality of preamplifiers, wherein two source circuits of the plurality of source circuits include a substantially equal number of source amplifiers, wherein two resistance arrays of the plurality of resistance arrays are operable to supply the second gradation voltages to corresponding source circuits of the two source circuits, wherein the plurality of source amplifiers are arrayed along the first direction, wherein the gradation circuit, the two source circuits, and the two resistance arrays are formed on a single semiconductor substrate, wherein the two resistance arrays are each disposed in a substantially center portion of a corresponding source circuit of the two source circuits along the first direction, wherein gradation lines are wired from each resistance array of the two resistance arrays to opposing ends of the corresponding source circuit, the opposing ends being relative to the first direction, and wherein each gradation line of the gradation lines is determined to have a maximum resistance corresponding to a line length of one-half the width of the corresponding source circuit.

13. The display device of claim 12, wherein:

the display drive circuit includes a master display driver integrated circuit (IC) and at least one slave display driver IC, the master display driver IC and the at least one slave display driver IC each include divisions of the plurality of source amplifiers configured to drive different groups of the source lines of the plurality of source lines, the master display driver IC includes:

the plurality of preamplifiers;

a plurality of master source circuits included in the plurality of source circuits; and a plurality of master resistance arrays provided corresponding to the plurality of master source circuits, wherein the plurality of master resistance arrays is configured to divide the first gradation voltages output from the plurality of preamplifiers to generate the second gradation voltages and supply the second gradation voltages to a corresponding master source circuit, the master display driver IC is provided on a single semiconductor substrate, the master display driver IC is configured to output the first gradation voltages to components external to a chip that includes the display drive circuit, the at least one slave display driver IC is configured to accept as input the first gradation voltages output by the master display driver IC, the at least one slave display driver IC includes:

a plurality of slave preamplifiers configured to output internal first gradation voltages based on the input first gradation voltages;

a plurality of slave source circuits included in the plurality of source circuits, and different from the plurality of master source circuits; and a plurality of slave resistance arrays corresponding to the plurality of slave source circuits and configured to divide the first gradation voltages output by the plurality of slave preamplifiers to generate second gradation voltages and supply the second gradation voltages to corresponding slave source circuits, and the at least one slave display driver IC is formed on a single semiconductor substrate different from the single semiconductor substrate on which the master display driver IC is formed.

* * * * *